US011092361B2

(12) United States Patent
Noh et al.

(10) Patent No.: US 11,092,361 B2
(45) Date of Patent: Aug. 17, 2021

(54) LINEAR COMPRESSOR

(71) Applicant: LG Electronics Inc., Seoul (KR)

(72) Inventors: Kiwon Noh, Seoul (KR); Kyunyoung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 118 days.

(21) Appl. No.: 16/457,485

(22) Filed: Jun. 28, 2019

(65) Prior Publication Data

US 2020/0003454 A1 Jan. 2, 2020

(30) Foreign Application Priority Data

Jun. 29, 2018 (KR) ..... 10-2018-0075749
Jun. 29, 2018 (KR) ..... 10-2018-0075808

(51) Int. Cl.

| | |
|---|---|
| ***F25B 1/02*** | (2006.01) |
| ***F04B 35/04*** | (2006.01) |
| ***F04B 39/00*** | (2006.01) |
| ***F04B 39/10*** | (2006.01) |
| ***F04B 39/12*** | (2006.01) |

(52) U.S. Cl.

CPC ..... *F25B 1/02* (2013.01); *F04B 35/045* (2013.01); *F04B 39/0005* (2013.01); *F04B 39/102* (2013.01); *F04B 39/121* (2013.01); *F04B 39/122* (2013.01); *F04B 39/127* (2013.01); *F04B 2201/0201* (2013.01); *F25B 2400/073* (2013.01)

(58) Field of Classification Search

CPC .. F04B 35/045; F04B 39/0005; F04B 39/102; F04B 39/121; F04B 39/122; F04B 39/127; F04B 2201/0201; F25B 1/02; F25B 2400/073

See application file for complete search history.

(56) References Cited

U.S. PATENT DOCUMENTS

| | | | | |
|---|---|---|---|---|
| 8,556,599 | B2 * | 10/2013 | Lee | F04B 35/045 417/417 |
| 9,022,757 | B2 * | 5/2015 | Shin | F04C 29/0035 418/55.1 |
| 9,856,867 | B2 * | 1/2018 | Kim | F04B 39/121 |
| 10,400,757 | B2 * | 9/2019 | Jeon | F04B 39/0044 |

(Continued)

FOREIGN PATENT DOCUMENTS

| | | |
|---|---|---|
| EP | 2910782 | 8/2015 |
| EP | 2977608 | 1/2016 |
| EP | 3196460 | 7/2017 |

(Continued)

OTHER PUBLICATIONS

Extended European Search Report in European Application No. 19180923.5, dated Sep. 27, 2019, 9 pages.

*Primary Examiner* — Patrick Hamo
(74) *Attorney, Agent, or Firm* — Fish & Richardson P.C.

(57) ABSTRACT

Provided is a linear compressor. The linear compressor includes a shell defining an internal space and a compressor body disposed in the internal space. Also, the shell includes a shell body having both ends that are opened and a suction shell cover and a discharge shell cover, which are respectively coupled to both the ends of the shell body to close the internal space. Here, the discharge shell cover is provided in shape that is capable of assisting heat dissipation of the frame.

20 Claims, 13 Drawing Sheets

(56) References Cited

U.S. PATENT DOCUMENTS

| | | | | |
|---|---|---|---|---|
| 2017/0204841 | A1* | 7/2017 | Jeon | F04B 39/121 |
| 2019/0234391 | A1* | 8/2019 | Noh | F04B 39/14 |

FOREIGN PATENT DOCUMENTS

| | | |
|---|---|---|
| KR | 1020060025733 | 3/2006 |
| KR | 1020060081482 | 7/2006 |
| KR | 1020170074527 | 6/2017 |
| KR | 1020170124908 | 11/2017 |
| KR | 1020180040791 | 4/2018 |

* cited by examiner

LINEAR COMPRESSOR

CROSS-REFERENCE TO RELATED APPLICATIONS

The present application claims priority under 35 U.S.C. 119 and 35 U.S.C. 365 to Korean Patent Application No. 10-2018-0075749, filed on Jun. 29, 2018, and Korean Patent Application No. 10-2018-0075808, filed on Jun. 29, 2018, disclosures of which are hereby incorporated by reference in their entirety.

BACKGROUND

The present disclosure relates to a linear compressor.

In general, compressors are machines that receive power from a power generation device such as an electric motor or a turbine to compress air, a refrigerant, or various working gases, thereby increasing a pressure. Compressors are being widely used in home appliances or industrial fields.

Compressors are largely classified into reciprocating compressors, rotary compressors, and scroll compressors.

In such a reciprocating compressor, a compression space, in which a working gas is suctioned or discharged, is provided between a portion and a cylinder so that a refrigerant is compressed while the piston linearly reciprocates within the cylinder.

In addition, in such a rotary compressor, a compression space, in which a working gas is suctioned or discharged, is provided between a roller that rotates eccentrically and a cylinder so that a refrigerant is compressed while the roller rotates eccentrically along an inner wall of the cylinder.

In addition, in such a scroll compressor, a compression space, in which a working gas is suctioned and discharged, is provided between an orbiting scroll and a fixed scroll so that a refrigerant is compressed while the orbiting scroll rotates along the fixed scroll.

In recent years, a linear compressor, which is directly connected to a driving motor, in which a piston linearly reciprocates, to improve compression efficiency without mechanical losses due to motion conversion and has a simple structure, is being developed.

The linear compressor suctions and compresses a refrigerant within a sealed shell while a piston linearly reciprocates within the cylinder by a linear motor and then discharges the compressed refrigerant.

In relation to the linear compressor having the above-described structure, the present applicant has field a prior art document 1.

<Prior Art Document 1>

1. Patent Publication Number: 10-2018-0040791 (Date of Publication: Apr. 23, 2018)

2. Tile of the Invention: LINEAR COMPRESSOR

The permanent magnet and the piston may move to compress the refrigerant according to the structure disclosed in the prior art document 1. In detail, the suction refrigerant passes through a piston port and then is introduced into the compression chamber so as to be compressed by the piston. Also, the compressed high-temperature refrigerant is discharged to the outside of a shell via a discharge room defined in a discharge cover.

Here, the linear compressor disclosed in the prior art document 1 has the following limitations.

(1) The discharge cover and a frame are overheated due to the compressed high-temperature refrigerant, and thus, heat is transferred from the frame to the piston and a cylinder. Particularly, the frame, the piston, and the cylinder may be disposed to contact each other so that the heat of the frame is easily transferred to the piston and the cylinder by conduction.

(2) As described above, as the frame is overheated, the heat transferred to the piston and the cylinder may overheat the suction refrigerant. Thus, the suction refrigerant may increase in volume to deteriorate compression efficiency.

(3) Also, vibration may be transmitted to the outside by a driving part including the reciprocating piston Particularly, there is a limitation that the vibration of the driving part is relatively well transmitted to the outside through the shell.

(4) Also, it is necessary to fix a compressor body disposed inside the shell in preparation for an impact occurring while the linear compressor moves. Here, a stopper for fixing the compressor body has to be disposed within the shell as a separate component.

Also, the linear motor is configured to allow a permanent magnet to be disposed between an inner stator and an outer stator. The permanent magnet is driven to linearly reciprocate by electromagnetic force between the permanent magnet and the inner (or outer) stator. Also, since the permanent magnet is driven in a state where the permanent magnet is connected to the piston, the permanent magnet suctions and compresses the refrigerant while linearly reciprocating within the cylinder and then discharge the compressed refrigerant.

In relation to the linear compressor having the above-described structure, the present applicant has field a prior art document 2.

<Prior Art Document 2>

1. Patent Publication Number: 10-2017-0124908 (Date of Publication: Nov. 13, 2017)

2. Tile of the Invention: LINEAR COMPRESSOR

The permanent magnet and the piston may move to compress the refrigerant according to the structure disclosed in the prior art document 2. In detail, the suction refrigerant passes through a piston port and then is introduced into the compression chamber so as to be compressed by the piston. Also, the compressed high-temperature refrigerant is discharged to the outside of a shell via a discharge room defined in a discharge cover.

Here, the linear compressor disclosed in the prior art document 2 has the following limitations.

(1) The compressed high-temperature refrigerant may flow to a front surface of the cylinder, and thus, a relatively large amount of heat may be transferred to the cylinder. Also, the heat transferred to the cylinder may overheat the suction refrigerant accommodated in the piston. Thus, the suction refrigerant may increase in volume to deteriorate compression efficiency.

(2) Also, heat of a discharge unit through which the high-temperature refrigerant flows may be conducted to a frame. Thus, the frame may be overheated, and then, the heat may be transferred to the piston and the cylinder to overheat the suction refrigerant. Thus, the suction refrigerant may increase in volume to deteriorate compression efficiency.

SUMMARY

Embodiments provide a linear compressor provided with a shell cover having a shape that assists heat dissipation of a frame.

Embodiments also provide a linear compressor in which a shell cover is reinforced in rigidity to increase in natural frequency of an entire shell and thereby to reduce noise transmitted to the outside.

Embodiments also provide a linear compressor provided with an insulation member seated on a front surface of a cylinder.

Embodiments also provide a linear compressor provided with an insulation member that extends up to a front surface of a frame as well as a cylinder.

A linear compressor according to an embodiment includes a shell cover provided in a shape that assists heat dissipation of a frame.

In detail, the linear compressor includes a shell defining an internal space and a compressor body disposed in the internal space. Also, the shell includes a shell body having both ends that are opened and a suction shell cover and a discharge shell cover, which are respectively coupled to both the ends of the shell body to close the internal space.

Here, the discharge shell cover includes a first portion extending in an axial direction to contact an inner surface of the shell body, a second portion extending from one side of the first portion in a radial direction to close one side of the internal space, and a third portion extending from the other side of the first portion in the radial direction to define a discharge shell opening.

A linear compressor according to an embodiment includes an insulation member that prevents heat from being transferred to a cylinder.

In detail, the linear compressor includes a piston reciprocating in the axial direction, a cylinder configured to define a compression space in which a refrigerant is compressed by the piston, a discharge unit configured to define a discharge space through which the refrigerant discharged from the compression space flows, and a frame accommodated in the cylinder and coupled to the discharge unit.

Here, the insulation member may be disposed between a discharge valve configured to open and close the compression space and the cylinder and discharge unit to allow the refrigerant of the compression space to be discharged to the discharge space.

The details of one or more embodiments are set forth in the accompanying drawings and the description below. Other features will be apparent from the description and drawings, and from the claims.

DETAILED DESCRIPTION OF THE EMBODIMENTS

Figure 1:
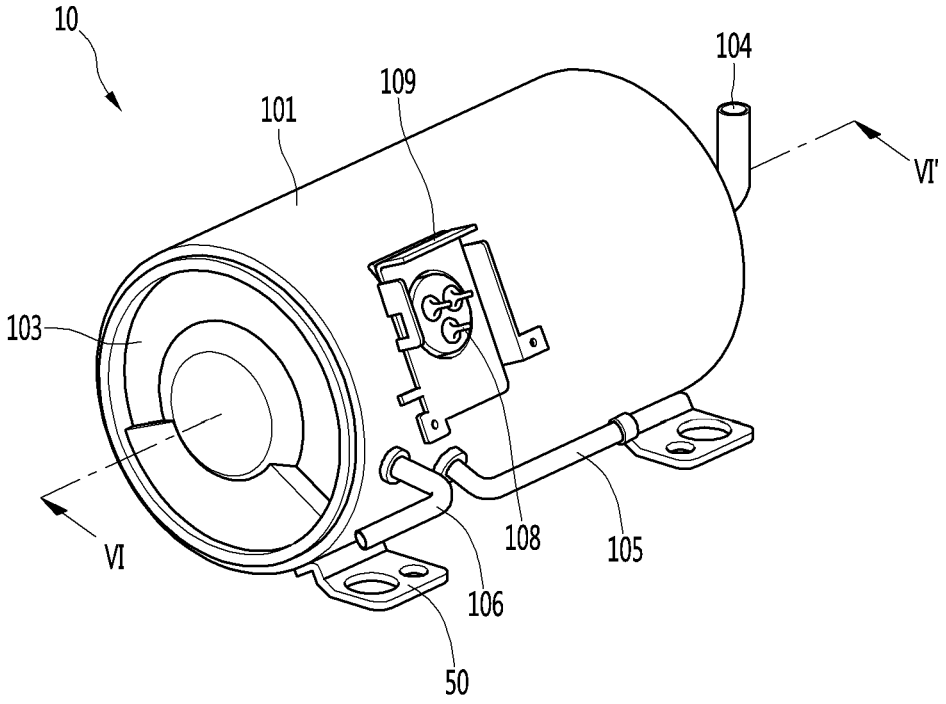
FIG. 1 is a view of a linear compressor according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. In the following description of the present disclosure, a detailed description of known functions and configurations incorporated herein will be omitted to avoid making the subject matter of the present disclosure unclear.

In the description of the elements of the present disclosure, the terms first, second, A, B, (a), and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
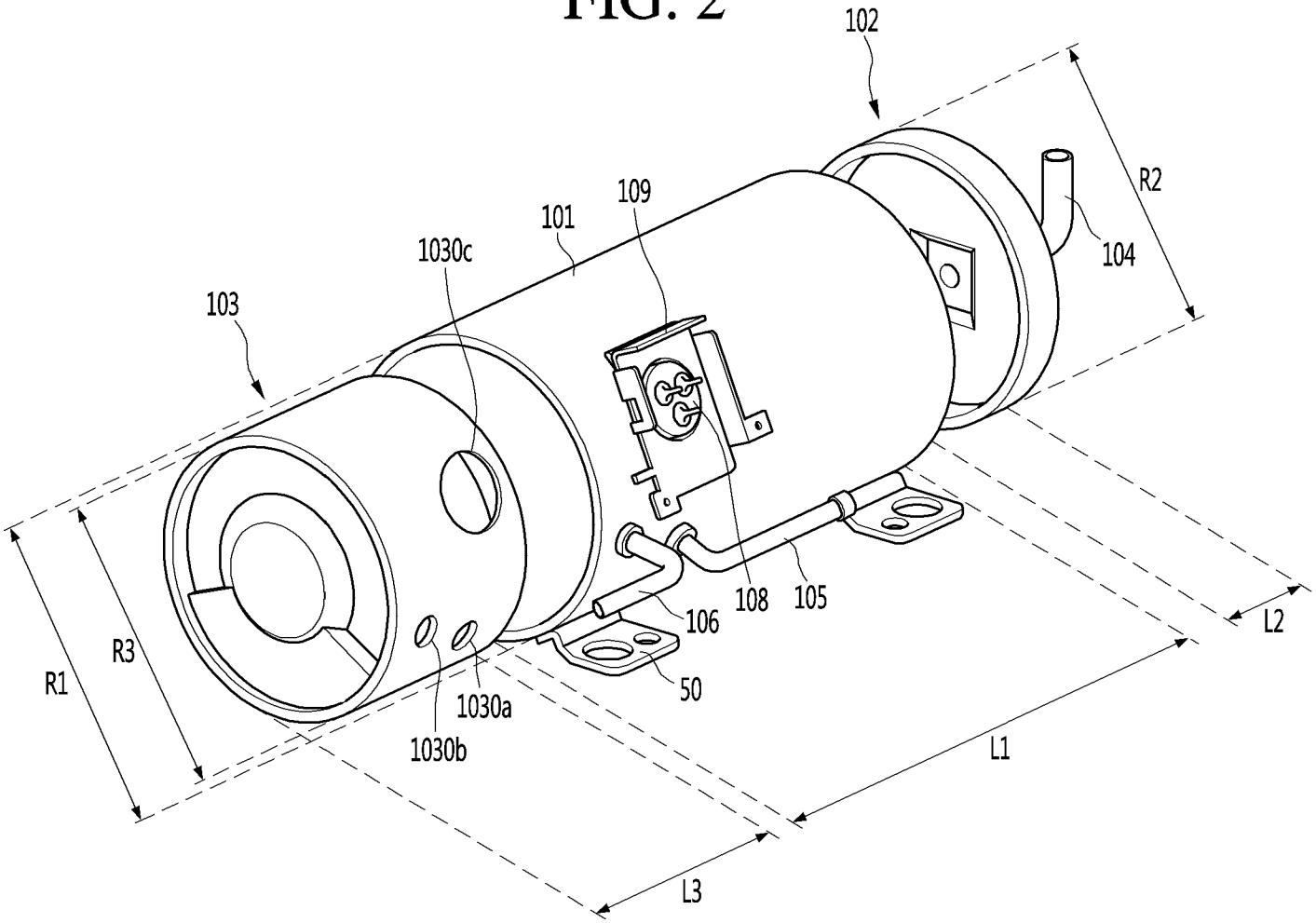
FIG. 2 is an exploded view illustrating a shell of the linear compressor according to an embodiment.

FIG. 1 is a view of a linear compressor according to an embodiment, and FIG. 2 is an exploded view illustrating a shell of the linear compressor according to an embodiment.

As illustrated in FIG. 1, a linear compressor 10 according to an embodiment includes a shell 101, 102, and 103, which define an outer appearance of the linear compressor 10. The shell 101, 102, and 103 may have a cylindrical shape with an empty inside as a whole. In detail, the shell 101, 102, and 103 has a cylindrical shape with a length L extending in an axial direction and a diameter R extending in a radial direction.

Here, the axial direction may mean a direction in which a piston 130 that will be described below reciprocates. In detail, a central axis of the shell 101, 102, and 103 in a longitudinal direction may correspond to a central axis of a compressor body that will be described below, and the central axis of the compressor body may correspond to a central axis of the piston 130 constituting the compressor body.

An axial direction of the shell 101, 102, and 103 may be disposed in parallel to a bottom surface. That is, the shell 101, 102, and 103 may extend in parallel to the bottom surface and have a somewhat low height from the bottom surface. Thus, a height of a space in which the linear compressor 10 is installed may be reduced.

A leg 50 may be coupled to a lower portion of each of the shells 101, 102, and 103. The leg 50 may be coupled to a base of a product in which the linear compressor 10 is installed. For example, the product may include a refrigerator, and the base may include a machine room base of the refrigerator. For another example, the product may include an outdoor unit of an air conditioner, and the base may include a base of the outdoor unit.

The shell includes a shell body 101 and shell covers 102 and 103, which are separably coupled to each other. In general, the shell covers 102 and 103 may be press-fitted into the shell body 101 and then welded to be coupled to each other shell body 101. As described above, since the shell body 101 and the shell covers 102 and 103 are coupled to each other, an internal space of the shell 101, 102, and 103 may be sealed.

The shell body 101 may have a cylindrical shape with both ends opened. In detail, the shell body 101 has a shell body length L1 in the axial direction and a shell body diameter R1 in the radial direction. For example, the shell body 101 may be manufactured by rolling a rectangular flat plate having a length L1 and a width R1*π. Here, a thickness of the flat plate is referred to as a shell body thickness T1.

A terminal 108 may be installed on an outer circumferential surface of the shell body 101. The terminal 108 may be understood as a component for transmitting external power to a motor assembly 140 that will be described below. Also, the terminal 108 may be installed on an outer circumferential surface of the shell body 101 overlapping the discharge shell cover 103. Thus, a terminal through-hole 1030*c* corresponding to the terminal 108 may be defined in the discharge shell cover 103.

Also, a bracket 109 surrounding the outside of the terminal 108 is installed on the outer circumferential surface of the shell body 101. The bracket 109 may have a structure that protrudes outward from the outer circumferential surface of the shell body 101 in the radial direction. Here, the bracket 109 may protect the terminal 108 against an external impact and the like.

The shell covers 102 and 103 are coupled to both opened ends of the shell body 101, respectively. That is to say, the shell covers 102 and 103 may be disposed to face each other. The shell cover includes a suction shell cover 102 coupled to one opened side of the shell body 101 and a discharge shell cover 103 coupled to the other opened side of the shell body 101.

FIGS. 1 and 2, the suction shell cover 102 may be disposed at a right portion of the linear compressor 10, and the discharge shell cover 103 may be disposed at a left portion of the linear compressor 10. Also, the suction shell cover 102 may be disposed at a suction-side of the refrigerator, and the discharge shell cover 103 may be disposed at a discharge-side of the refrigerator.

The suction shell cover 102 is provided in a cylindrical shape of which one end is opened. In detail, the suction shell cover 102 has a suction shell length L2 in the axial direction and a suction shell diameter R2 in the radial direction. Referring to FIG. 2, the suction shell length L2 may be less than the suction shell diameter R2, and thus, the suction shell cover 102 may have a bowl shape as a whole.

The discharge shell cover 103 has a cylindrical shape of which one end is opened. In detail, the discharge shell cover 103 has a discharge shell length L3 in the axial direction and a discharge shell diameter R3 in the radial direction. Here, the discharge shell cover 103 has a relatively long discharge shell length L3 and has a cylindrical shape as a whole.

In summary, the discharge shell length L3 is greater than the suction shell length L2 (L3>L2). In detail, the discharge shell length L3 is provided to be greater twice or more than the suction shell length L2 (L3>L2*2). Also, the discharge shell length L3 may be provided to be 0.25 times or more of the shell body length L1 (L3>L1*0.25).

This is done for a reason in which the discharge shell cover 103 extends up to a front side of the frame 110 that will be described below. Also, this is done for reducing vibration through the discharge shell cover 103. This will be described in detail later.

The suction shell diameter R2 and the discharge shell diameter R3 may be the same (R2=R3). That is, the discharge shell cover 103 may have the same diameter as the suction shell cover 102 in the radial direction and further extend in the axial direction.

Also, the shell body diameter R1, the suction shell diameter R2, and the discharge shell diameter R3 differ by the shell body thickness T1 (R1−2*T1=R2=R3). That is, an outer diameter of the shell body 101 may correspond to the shell body diameter R1, and an inner diameter of the shell body 101 may correspond to the discharge shell diameter R3. Thus, the shell covers 102 and 103 may be inserted to be fitted into the shell body 101.

Also, the suction shell cover 102 and the discharge shell cover 103 have a suction shell thickness T2 and a discharge shell thickness T3, respectively. Thus, an outer diameter of the suction shell cover 102 correspond to the suction shell diameter R2, and an inner diameter of the suction shell cover 102 may correspond to a value of R2−2*T2. An outer diameter of the discharge shell cover 103 may correspond to the discharge shell diameter R3, and the inner diameter of the discharge shell cover 103 may correspond to a value of R3−2*T3.

Also, the shell body thickness T1, the suction shell thickness T2, and the discharge shell thickness T3 may be the same. Such numerical values may be understood as values without considering an assembly tolerance and a design tolerance, but are not limited thereto.

The linear compressor 10 further include a plurality of pipes 104, 105, and 106 through which the refrigerant is suctioned, discharged, or injected. The plurality of pipes 104, 105, and 106 include a suction pipe 104, a discharge pipe 105, and a process pipe 106.

The suction pipe 104 is installed so that the refrigerant is suctioned into the linear compressor 10. For example, the suction pipe 104 may be coupled to the suction shell cover 102.

In detail, the suction pipe 104 may pass in the axial direction so as to be coupled to a central side of the suction shell cover 102 in the radial direction. Thus, the refrigerant may be suctioned into the linear compressor 10 through the suction pipe 104 in the axial direction.

Here, the suction shell cover 102 may be provided so that a portion of the suction shell cover 102, which is coupled to the suction pipe 104, protrudes outward in the axial direction. Here, the outside of the suction shell cover 102 in the axial direction is understood as a direction that is away from the shell body 101.

The discharge pipe 105 is installed so that the compressed refrigerant is discharged from the linear compressor 10. For example, the discharge pipe 105 may be coupled to an outer circumferential surface of the shell body 101.

In detail, the discharge pipe 105 passes to be coupled to the outer circumferential surface of the shell body 101 in the radial direction. The refrigerant suctioned through the suction pipe 104 may be compressed while flowing in the axial direction, and the compressed refrigerant may be discharged through the discharge pipe 105 in the radial direction.

Here, the discharge pipe 105 may be disposed on a portion at which the discharge shell cover 103 and the shell body 101 overlap each other. Thus, a discharge pipe through-hole 1030*a* through which the discharge pipe 105 passes is defined in the discharge shell cover 103.

The process pipe 106 may be installed to supplement a predetermined refrigerant into the linear compressor 10. A worker may inject the refrigerant into the linear compressor 10 through the process pipe 106. For example, the process pipe 106 may be coupled to the outer circumferential surface of the shell body 101.

In detail, the process pipe 106 may be coupled to the shell body 101 at a height different from that of the discharge pipe 105 to avoid interference with the discharge pipe 105. The height is understood as a distance in a vertical direction from the bottom surface or the leg 50. Since the discharge pipe 105 and the process pipe 106 are coupled to the outer circumferential surface of the shell body 101 at the heights different from each other, work convenience may be improved.

Also, the process pipe 105 may be disposed on a portion at which the discharge shell cover 103 and the shell body 101 overlap each other. Thus, a process pipe through-hole 1030*b* through which the process pipe 105 passes is defined in the discharge shell cover 103.

Also, the process pipe through-hole 1030*b* may have a diameter less than that of the process pipe 106. Thus, the process pipe through-hole 1030*b* may serve as resistance of the refrigerant injected through the process pipe 106.

Thus, in view of a passage of the refrigerant, a passage of the refrigerant introduced through the process pipe 106 may have a size that gradually decreases while passing through the discharge shell cover 103. Also, the size of the passage may decrease again while entering into the internal space of the shell body 101.

In this process, a pressure of the refrigerant may be reduced to allow the refrigerant to be vaporized. Also, an oil component contained in the refrigerant may be separated. Thus, the refrigerant from which the oil component is separated may be introduced into the piston 130 that will be described below to improve compression performance of the refrigerant. The oil component may be understood as working oil existing in a cooling system.

Hereinafter, the discharge shell cover 103 in which the discharge pipe through-hole 1030*a*, the process pipe through-hole 1030*b*, and the terminal through-hole 1030*c* are defined will be described in detail.

Figure 3:
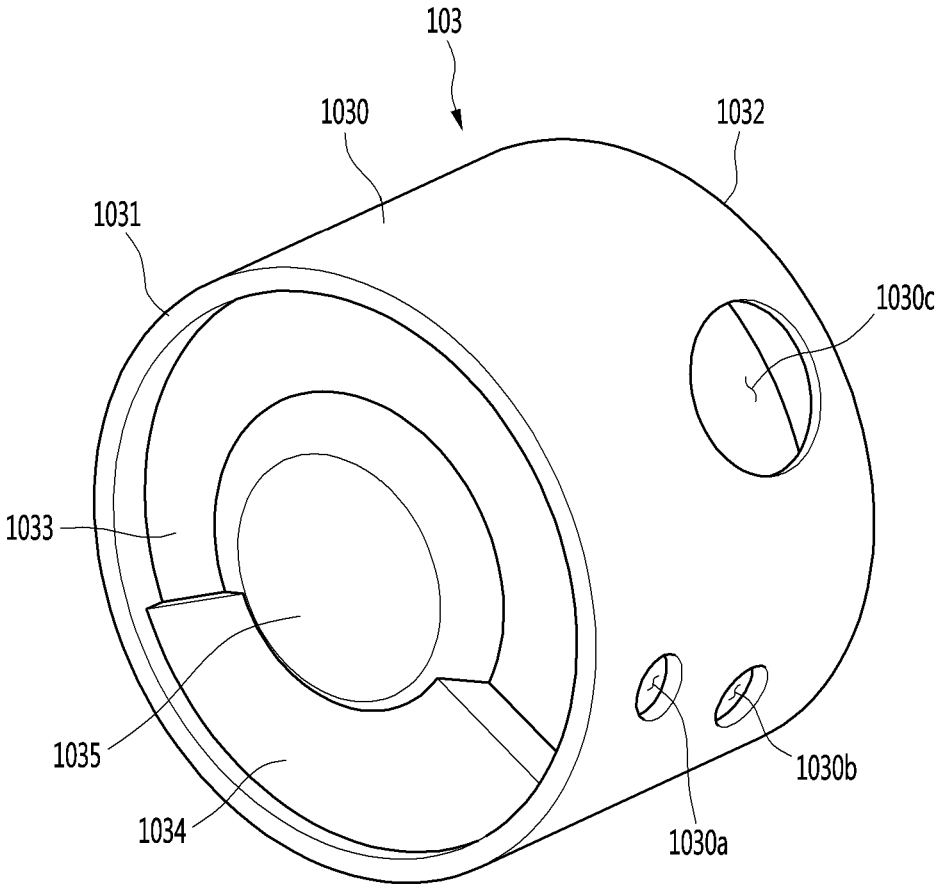
FIGS. 3 and 4 are views illustrating a discharge shell cover of the linear compressor according to an embodiment.
Figure 4:
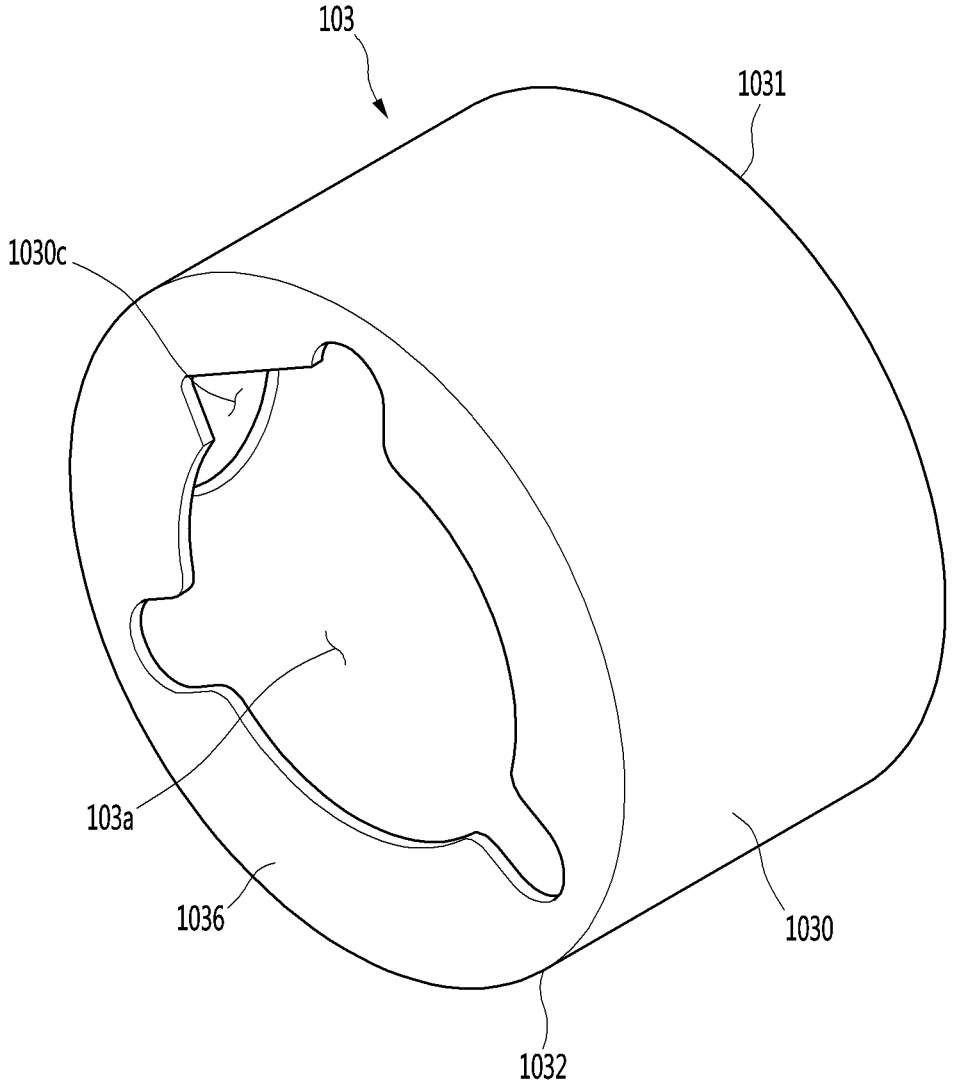

FIGS. 3 and 4 are views illustrating the discharge shell cover of the linear compressor according to an embodiment. FIG. 3 is an outer perspective view of the discharge shell cover 103, and FIG. 4 is an inner perspective view of the discharge shell cover 103. Here, the outside may be the outside of the shell, and the inside may be the inside of the shell.

As illustrated in FIGS. 3 and 4, the discharge shell cover 103 may have a cylindrical shape with one opened side and one closed side. In detail, the discharge shell cover 103 includes a first portion 1030 defining a cylindrical side surface and second and third portions 1033 and 1036 respectively extending from both sides of the first portion 1030.

The first portion 1030, the second portion 1033, and the third portion 1036 may be integrally provided and may correspond to separate constituents for convenience of explanation. Also, the first portion 1030, the second portion 1033, and the third portion 1036 may be provided as constituents that are separately manufactured and then coupled to each other.

The first portion 1030 may correspond to a portion contacting an inner surface of the shell body 101. Particularly, an outer circumferential surface of the first portion 1030 may contact the inner circumferential surface of the shell body 101.

In detail, the first portion 1030 has the discharge shell length L3 in the axial direction and the discharge shell diameter R3 in the radial direction. Particularly, the first portion 1030 may be manufactured by bending a rectangular flat plate having a length L3 and a width R3*π. Here, a thickness of the flat plate corresponds to the discharge shell thickness T3.

Also, a plurality of openings are defined in the first portion 1030. The plurality of openings include the discharge pipe through-hole 1030*a*, the process pipe through-hole 1030*b*, and the terminal through-hole 1030*c*. The through-holes 1030*a*, 1030*b*, and 1030*c* may have different sizes and positions according to a design.

Here, both ends of the first portion 1030 may be an outer end 1031 and an inner end 1032. The outer end 1031 may be disposed outside the shell 101, 102, and 103, and the inner end 1032 may be disposed inside the shell 101, 102, and 103. That is, the outer end 1031 corresponds to a portion that is exposed to the outside of the shell 101, 102, 103 when the discharge shell cover 103 is coupled to the shell body 101.

The second portion 1033 may correspond to a closed side surface of the discharge shell cover 103. In detail, the second portion 1033 is provided in a circular plate shape extending radially inward from the outer end 1031. That is, the second portion 1033 may be understood as a discharge cap for closing the discharge side of the shell.

Also, the second portion 1033 may be recessed by a predetermined depth from the outer end 1031 in the axial direction. Also, the second portion 1033 includes a first protrusion 1035 and a second protrusion 1034, which protrude in the axial direction.

Here, the first protrusion 1035 and the second protrusion 1034 are disposed at a rear side of the outer end 1031 in the axial direction. That is, the second portion 1033 is recessed so that the first protrusion 1035 and the second protrusion 1034 do not protrude forward from the outer end 1031 in the axial direction.

Thus, the outer end 1031 may be understood as the same portion as the outer end of the discharge shell cover 103.

The first protrusion 1035 protrudes so as not to interfere with the discharge cover 192 that will be described later. Thus, the first protrusion 1035 may have a size corresponding to that of an upper end of the discharge cover 192. In detail, the first protrusion 1035 may have a circular shape with a predetermined diameter at a central portion of the second portion 1033 in the radial direction.

The second protrusion 1034 protrudes so as not to interfere with a discharge shell support device 180 that will be described later. Thus, the second protrusion 1034 may have a size corresponding to that of the discharge shell support device 180. In detail, the second protrusion 1034 has a fan shape below the first protrusion 1035.

Particularly, the second protrusion 1034 may be angled at an angle of about 120 degrees with respect to a lower end thereof. This is done because the discharge shell support device 180 is installed at an angle of about 120 degrees with respect to the lower end thereof. Here, the second protrusion 1034 may have a protruding length that is relatively less than that of the first protrusion 1035.

The third portion 1036 may correspond to an opened side surface of the discharge shell cover 103. In detail, the third portion 1036 extends inward from the inner end 1032 in the radial direction to define a predetermined opening. Here, the opening defined by the third portion 1036 may be referred to as a discharge shell opening 103*a*.

The discharge shell opening 103*a* may have a shape corresponding to that of the discharge cover 192 that will be described later. That is, the discharge shell opening 103*a* may be disposed in the same line as the discharge cover 192 in the radial direction.

Also, although not shown, the discharge shell opening 103*a* may be provided in a shape for avoiding the interference with the terminal 108 or a terminal part 141*d* that will be described later. That is, the discharge shell opening 103*a* may have various shapes without being limited to the shape illustrated in FIG. 4.

Also, although the second portion 1033 is recessed to extend from the outer end 1031, the third portion 1036 extends from the inner end 1032. On the other hands, the inner end of the discharge shell cover 103 may be understood as the third portion 1036. Thus, the inner end of the discharge shell cover 103 may extend inward in the radial direction to define a predetermined opening.

Hereinafter, an internal constituent disposed in the internal space defined by the shall body 101 and the shell covers 102 and 103 will be described in detail. Hereinafter, the internal constituent of the linear compressor is referred to as a compressor body.

Figure 5:
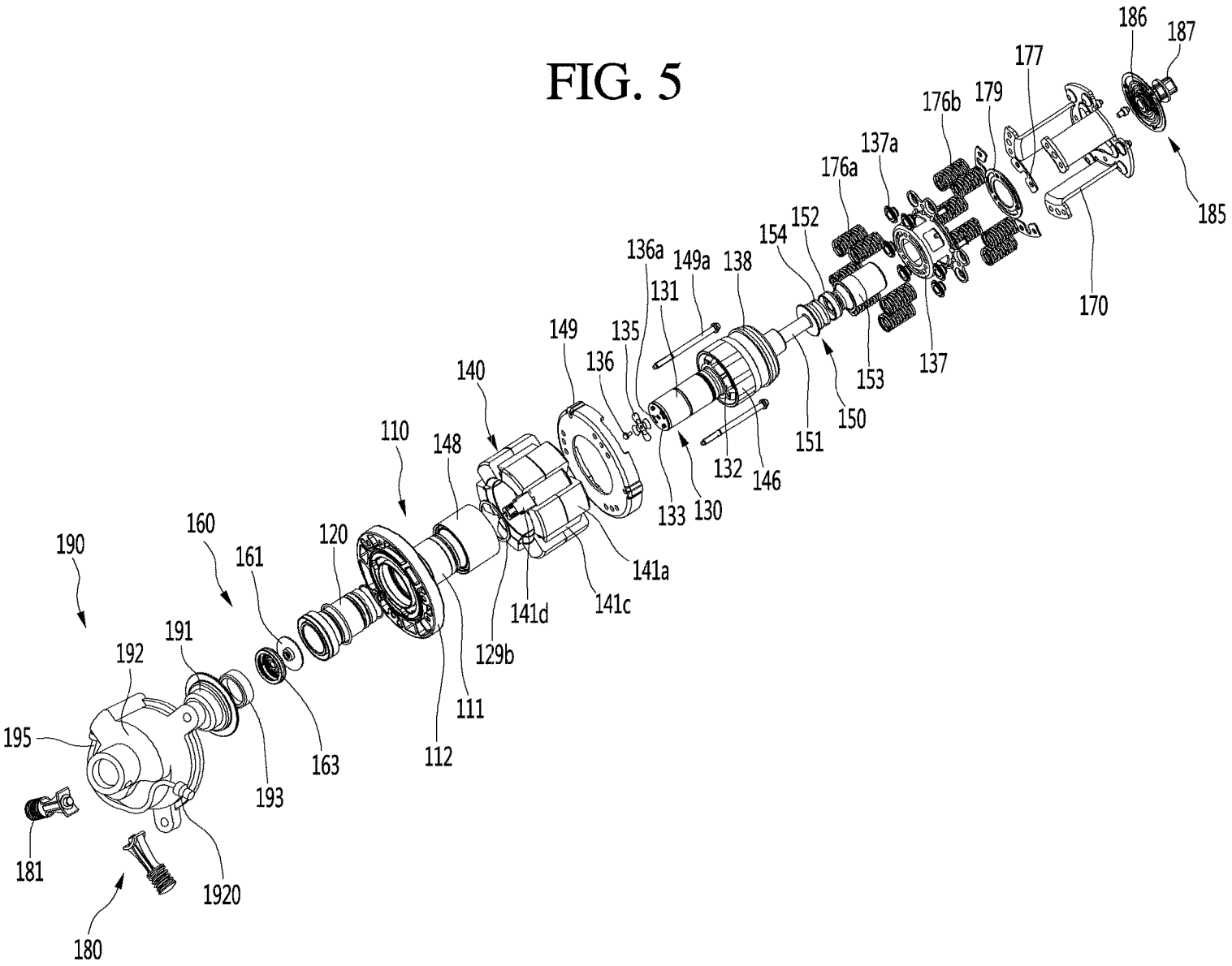
FIG. 5 is an exploded view illustrating an internal constituent of the linear compressor according to an embodiment.
Figure 6:
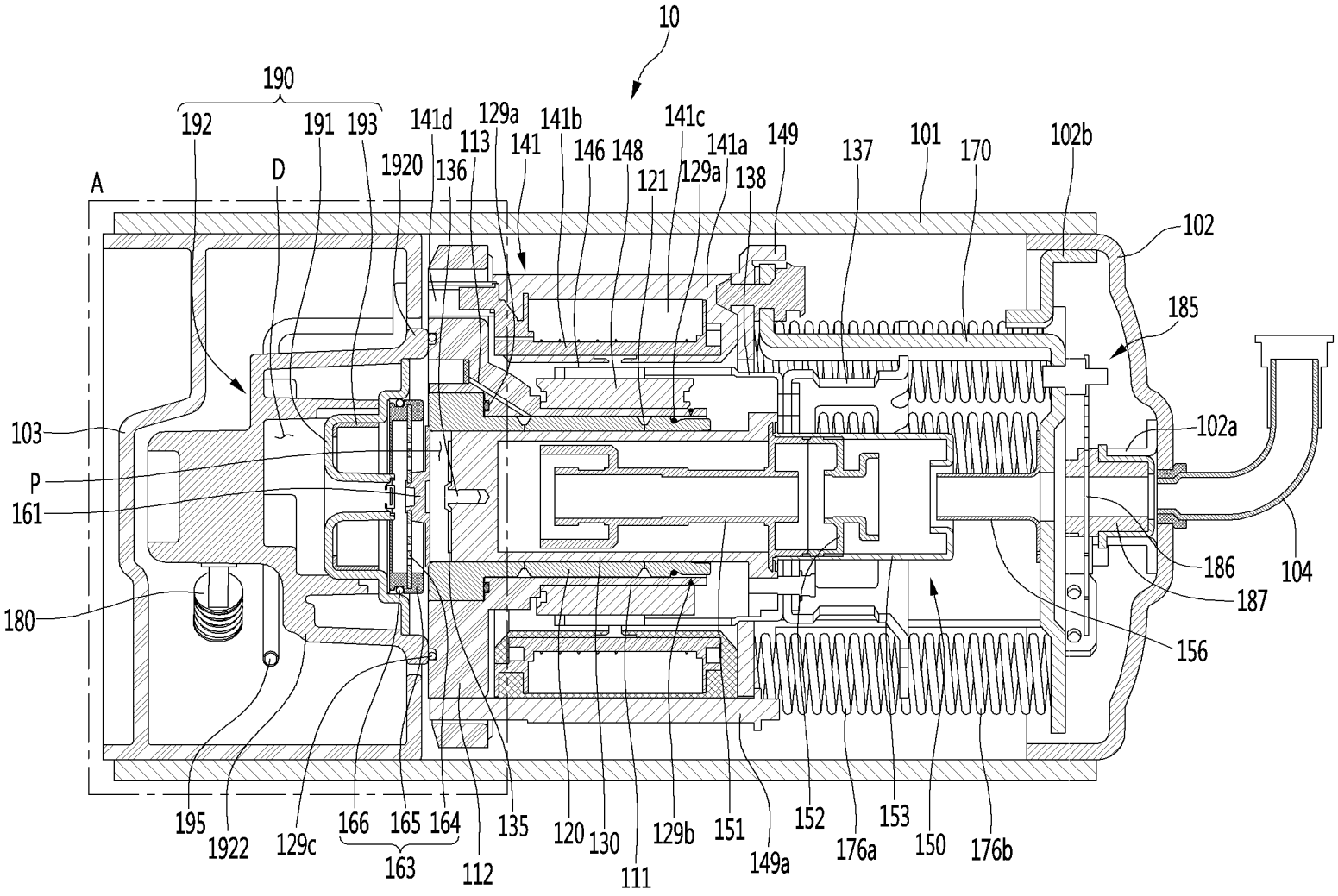
FIG. 6 is a cross-sectional view taken along line VI-VI' of FIG. 1.

FIG. 5 is an exploded view illustrating an internal constituent of the linear compressor according to an embodiment, and FIG. 6 is a cross-sectional view taken along line VI-VI' of FIG. 1. In FIG. 5, the shell and the pipes will be omitted so as to show the compressor body.

As illustrated in FIGS. 5 and 6, the linear compressor 10 according to an embodiment includes a frame 110, a cylinder 120, a piston 130 that linearly reciprocates within the cylinder 120, and a motor assembly 140 that functions as a linear motor for applying driving force to the piston 130. When the motor assembly 140 is driven, the piston 130 may linearly reciprocate in the axial direction.

Hereinafter, the direction will be defined.

The "axial direction" may be understood as a direction in which the piston 130 reciprocates, i.e., the horizontal direction in FIG. 6. Also, in the axial direction", a direction from the suction pipe 104 toward a compression space P, i.e., a direction in which the refrigerant flows may be defined as a "front direction", and a direction opposite to the front direction may be defined as a "rear direction". When the piston 130 moves forward, the compression space P may be compressed.

On the other hand, the "radial direction" may be understood as a direction that is perpendicular to the direction in which the piston 130 reciprocates, i.e., the vertical direction in FIG. 6. Also, a direction that is away from the central axis of the piston 130 may be defined as "the outside", and a direction that is close to the central axis may be defined as "the inside". The central axis of the piston 130 may correspond to the central axis of the shell 101, 102, and 103 as described above.

The frame 110 is understood as a component for fixing the cylinder 120. The frame 110 includes a frame body 111 extending in the axial direction and a frame flange 112 extending outward from the frame body 111 in the radial direction. Here, the frame body 111 and the frame flange 112 may be integrated with each other.

The cylinder 120 is accommodated in the frame body 111. For example, the cylinder 120 may be press-fitted into the frame body 111. Also, the cylinder 120 may be made of aluminum or an aluminum alloy material, like the frame 110.

The frame flange 112 extends from a front end of the frame body 111 in the radial direction. The frame flange 112 may be understood as a structure coupled to the discharge unit 190 that will be described later. One side of the outer stator 141 that will be described later is supported by the frame flange 112.

Also, the frame 110 includes a gas passage 113 for guiding a predetermined refrigerant to the cylinder 120. The gas passage 113 has one end disposed on a front surface of the frame flange 11 and the other end connected to an outer circumferential surface of the cylinder 120.

The cylinder 120 is configured to accommodate at least a portion of the piston 130. Also, the cylinder 120 has a compression space P in which the refrigerant is compressed by the piston 130.

Also, a gas inflow part 121 recessed inward from an outer circumference of the cylinder 120 in the radial direction contacting the gas passage 113 is provided. The gas inflow part 121 may be provided along the outer circumference of the cylinder 120 and provided in plurality spaced apart from each other in the axial direction. Also, the gas inflow part 121 may extend up to the outer circumference of the cylinder 120, i.e., an outer circumference of the piston 130.

A portion of the refrigerant discharged from the compression space P through the gas passage 113 may flow into the gas inflow part 121 to flow into the cylinder 120 and the piston 130. The refrigerant flowing as described above may provide lifting force to the piston 130 to perform a function of a gas bearing for the piston 130. According to the above-described effect, the bearing function may be performed by using at least a portion of the discharge refrigerant to prevent the piston 130 and the cylinder 120 from being worn.

The piston 130 includes a piston body 131 having an approximately cylindrical shape and a piston flange 132 extending from the piston body 131 in the radial direction. The piston body 131 may reciprocate inside the cylinder 120, and the piston flange 132 may reciprocate outside the cylinder 120.

A suction hole 133 through which the refrigerant is introduced into the compression space P is defined in a front surface of the piston body 131, and a suction valve 135 for selectively opening the suction hole 133 is disposed on a front side of the suction hole 133.

Also, a coupling hole 136*a* to which a predetermined coupling member 136 is coupled is defined in a front surface of the piston body 131. In detail, the coupling hole 136*a* may be defined in a center of the front surface of the piston body 131, and a plurality of suction holes 133 are defined to surround the coupling hole 136*a*. Also, the coupling member 136 passes through the suction valve 135 and is coupled to the coupling hole 136*a* to fix the suction valve 135 to the front surface of the piston body 131.

The motor assembly 140 includes an outer stator 141 fixed to the frame 110 and disposed to surround the cylinder 120, an inner stator 148 disposed to be spaced inward from the outer stator 141, and a permanent magnet 146 disposed in a space between the outer stator 141 and the inner stator 148.

The permanent magnet 146 may linearly reciprocate by a mutual electromagnetic force between the outer stator 141 and the inner stator 148. Also, the permanent magnet 146 may be provided as a single magnet having one polarity or be provided by coupling a plurality of magnets having three polarities to each other.

The permanent magnet 146 may be disposed on the magnet frame 138. The magnet frame 138 may have an approximately cylindrical shape and be disposed to be inserted into the space between the outer stator 141 and the inner stator 148.

In detail, in FIG. 6, the magnet frame 138 may be coupled to the piston flange 132 to extend outward in the radial direction and then be bent forward. Here, the permanent magnet 146 may be installed on a front portion of the magnet frame 138. Thus, when the permanent magnet 146 reciprocates, the piston 130 may reciprocate together with the permanent magnet 146 in the axial direction by the magnet frame 138.

The outer stator 141 includes coil winding bodies 141*b*, 141*c*, and 141*d* and a stator core 141*a*. The coil winding bodies 141*b*, 141*c*, and 141*d* include a bobbin 141*b* and a coil 141*c* wound in a circumferential direction of the bobbin 141*b*.

The coil winding bodies 141*b*, 141*c*, and 141*d* further include a terminal part 141*d* that guides a power line connected to the coil 141*c* so that the power line is led out or exposed to the outside of the outer stator 141. The terminal part 141*d* may pass through the frame 110 and then be coupled to the above-described terminal 108.

The stator core 141*a* includes a plurality of core blocks in which a plurality of laminations are laminated in a circumferential direction. The plurality of core blocks may be disposed to surround at least a portion of the coil winding bodies 141*b*, 141*c*, and 141*d*.

A stator cover 149 may be disposed on one side of the outer stator 141. That is, the outer stator 141 may have one side supported by the frame flange 112 and the other side supported by the stator cover 149.

Also, the linear compressor 10 further includes a cover coupling member 149*a* for coupling the stator cover 149 to the frame flange 112. Also, since the cover coupling member 149*a* is coupled to the stator cover 149 and the frame flange 112, the outer stator 141 may be fixed. That is, the cover coupling member 149*a* extends from the stator cover 149 to the frame flange 112.

The inner stator 148 is fixed to an outer circumferential surface of the frame body 111. Also, in the inner stator 148, the plurality of laminations are laminated outside the frame 111 in a circumferential direction.

Also, the linear compressor 10 further include a suction muffler 150 coupled to the piston 130 to reduce a noise generated from the refrigerant suctioned through the suction pipe 104. The refrigerant suctioned through the suction pipe 104 flows into the piston 130 via the suction muffler 150. For example, while the refrigerant passes through the suction muffler 150, the flow noise of the refrigerant may be reduced.

The suction muffler 150 includes a plurality of mufflers 151, 152, and 153. The plurality of mufflers 151, 152, and 153 include a first muffler 151, a second muffler 152, and a third muffler 153, which are coupled to each other.

The first muffler 151 is disposed within the piston 130, and the second muffler 152 is coupled to a rear side of the first muffler 151. Also, the third muffler 153 accommodates the second muffler 152 therein and extends to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

Also, the suction muffler 150 further includes a muffler filter 154. The muffler filter 154 may be disposed on an interface on which the first muffler 151 and the second muffler 152 are coupled to each other. For example, the muffler filter 154 may have a circular shape, and an outer circumferential portion of the muffler filter 154 may be supported between the first and second mufflers 151 and 152.

Also, the linear compressor 10 further includes a support 137 for supporting the piston 130. The support 137 may be coupled to a rear portion of the piston 130, and the muffler 150 may be disposed to pass through the inside of the support 137. Also, the piston flange 132, the magnet frame 138, and the support 137 may be coupled to each other by using a coupling member.

A balance weight 179 may be coupled to the support 137. A weight of the balance weight 179 may be determined based on a driving frequency range of the body of the compressor. Also, the support 137 may include a first spring support part 137*a* coupled to the first resonant spring 176*a* that will be described later.

Also, the linear compressor 10 further include a rear cover 170 coupled to the stator cover 149 to extend backward. The rear cover 170 includes three support legs, and the three support legs may be coupled to a rear surface of the stator cover 149.

Also, a spacer 177 may be disposed between the three support legs and the rear surface of the stator cover 149. A distance from the stator cover 149 to a rear end of the rear cover 170 may be determined by adjusting a thickness of the spacer 177. Also, the rear cover 170 may be spring-supported by the support 137.

Also, the linear compressor 10 further includes an inflow guide part 156 coupled to the rear cover 170 to guide an inflow of the refrigerant into the muffler 150. At least a portion of the inflow guide part 156 may be inserted into the suction muffler 150.

Also, the linear compressor 10 further includes a plurality of resonant springs 176*a* and 176*b* that are adjusted in natural frequency to allow the piston 130 to perform a resonant motion. The plurality of resonant springs 176*a* and 176*b* include a first resonant spring 176*a* supported between the support 137 and the stator cover 149 and a second resonant spring 176*b* supported between the support 137 and the rear cover 170.

The driving part that reciprocates within the linear compressor 10 may stably move by the action of the plurality of resonant springs 176*a* and 176*b* to reduce the vibration or noise due to the movement of the driving part.

Also, the linear compressor 10 includes a discharge unit 190 and a discharge valve assembly 160.

The discharge unit 190 defines a discharge space D of the refrigerant discharged from the compression space P. The discharge unit 190 includes a discharge cover 192, a discharge plenum 191, and a fixing ring 193.

The discharge cover 192 is coupled to the frame 110. Particularly, the discharge cover 192 is coupled to a front surface of the frame flange 112. In detail, the discharge cover 192 includes a cover flange part 1920 coupled to the front surface of the frame flange 112 and a chamber part 1922 extending forward from the cover flange part 1290 in the axial direction.

Here, the cover flange part 1920 may have a surface area less than that of the front surface of the frame flange 112. That is, at least a portion of the front surface of the frame flange 112 may be exposed to the inside of the shell 101, 102, and 102. This will be described in detail later.

The discharge plenum 191 is coupled to the inside of the discharge cover 192. Particularly, the discharge cover 192 and the discharge plenum 191 may be coupled to each other to define the plurality of discharge spaces D. The refrigerant discharged from the compression space P may sequentially pass through the plurality of discharge spaces D.

The fixing ring 193 is coupled to the inside of the discharge plenum 191. Here, the fixing ring 193 fixes the discharge plenum 191 to the discharge cover 192.

The discharge valve assembly 160 is coupled to the inside of the discharge unit 190 and discharges the refrigerant compressed in the compression space P to the discharge space D. Also, the discharge valve assembly 160 may include a discharge valve 161 and a spring assembly 163 providing elastic force in a direction in which the discharge valve 161 contacts the front end of the cylinder 120.

The spring assembly 163 may include a valve spring 164 having a plate spring shape, a spring support part 165 disposed on an edge of the valve spring 164 to support the valve spring 164, and a friction ring 166 inserted into an outer circumferential surface of the spring support part 165.

A central portion of a front surface of the discharge valve 161 is fixed and coupled to a center of the valve spring 164. Also, a rear surface of the discharge valve 161 contacts the front surface of the cylinder 120 by elastic force of the valve spring 164.

When a pressure in the compression space P is equal to or greater than the discharge pressure, the valve spring 164 is elastically deformed toward the discharge plenum 191. Also, the discharge valve 161 is spaced apart from a front end of the cylinder 120 so that the refrigerant is discharged into the discharge space D defined in the discharge plenum 191 in the compression space P.

That is, when the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

Here, the compression space P may be understood as a space defined between the suction valve 135 and the discharge valve 161. Also, the suction valve 135 may be disposed on one side of the compression space P, and the discharge valve 161 may be disposed on the other side of the compression space P, i.e., an opposite side of the suction valve 135.

While the piston 130 linearly reciprocates within the cylinder 120, when the pressure of the compression space P is less than a suction pressure of the refrigerant, the suction valve 135 may be opened to suction the refrigerant into the compression space P.

On the other hand, when the pressure in the compression space P is greater than the suction pressure of the refrigerant, the suction valve 135 is closed, and the piston moves forward to compress the refrigerant within the compression space P.

When the pressure in the compression space P is greater than the pressure (the discharge pressure) in the discharge space D, the valve spring 164 is deformed forward to separate the discharge valve from the cylinder 120. Also, the refrigerant within the compression space P is discharged into the discharge space D through a gap between the discharge valve 161 and the cylinder 120.

When the refrigerant is completely discharged, the valve spring 164 may provide restoring force to the discharge valve 161 so that the discharge valve 161 contact the front end of the cylinder 120 again.

Also, the linear compressor 10 may further include a cover pipe 195. The cover pipe 195 discharges the refrigerant flowing into the discharge unit 190 to the outside. Here, the cover pipe 195 has one end coupled to the discharge cover 192 and the other end coupled to the discharge pipe 105. Also, at least a portion of the cover pipe 195 may be made of a flexible material and roundly extend along the inner circumferential surface of the shell body 101.

Also, the linear compressor 10 includes the frame 110 and a plurality of sealing members for increasing coupling force between the peripheral components around the frame 110. Each of the plurality of sealing members may have a ring shape.

In detail, the plurality of sealing members may include a first sealing member 129*a* disposed on a portion at which the frame 110 and the cylinder 120 are coupled to each other, a second sealing member 129*b* disposed on a portion at which the frame 110 and the inner stator 148 are coupled to each other, and a third sealing member 129*c* disposed on a portion at which the discharge cover 192 is coupled.

Also, the linear compressor 10 includes support devices 180 and 185 for fixing the compressor body to the inside of the shell 101, 102, and 103. The support device includes a suction shell support device 185 coupled to the suction shell cover 102 and a discharge shell support device 180 coupled to the discharge shell cover 103.

The suction shell support device 185 includes a suction spring 186 provided in a circular plate spring shape and a suction spring support part 187 fitted into a center of the suction spring 186.

An outer edge of the suction spring 186 may be fixed to a rear surface of the rear cover 170 by a coupling member. The suction spring support part 187 is coupled to the cover support part 102*a* disposed at a center of the suction shell cover 102. Thus, the rear end of the compressor body may be elastically supported at the central portion of the suction shell cover 102.

Also, a suction stopper 102*b* may be disposed on an inner edge of the suction shell cover 102. The suction stopper 102*b* may be understood as a component for preventing the body of the compressor, particularly, the motor assembly 140 from being bumped by the shell 101, 102, and 103 and thus damaged due to the shaking, the vibration, or the impact occurring during the transportation of the linear compressor 10.

Particularly, the suction stopper 102*b* may be disposed adjacent to the rear cover 170. Thus, when the linear compressor 10 is shaken, the rear cover 170 may interfere with the suction stopper 102*b* to prevent the impact from being directly transmitted to the motor assembly 140.

The discharge shell support device 180 includes a pair of discharge support parts 181 extending in the radial direction. The discharge support part 181 has one end fixed to the discharge cover 192 and the other end contacting an inner circumferential surface of the discharge shell cover 103. Thus, the discharge support part 181 may support the compressor body in a radial direction.

For example, the pair of discharge springs 181 are disposed at an angle of about 90 degrees to about 120 degrees with respect to each other in the circumferential direction with respect to the lower end that is closest to the bottom surface. That is, the lower portion of the compressor body may be supported at two points. As described above, a second protrusion 1034 corresponding to the discharge spring 181 is disposed on the discharge shell cover 103.

Also, the discharge shell support device 180 may include a discharge sparing (not shown) installed in the axial direction. For example, the discharge spring (not shown) may be disposed between an upper end of the discharge cover 192 and a first protrusion 1035 of the discharge shell cover 103.

Figure 7:
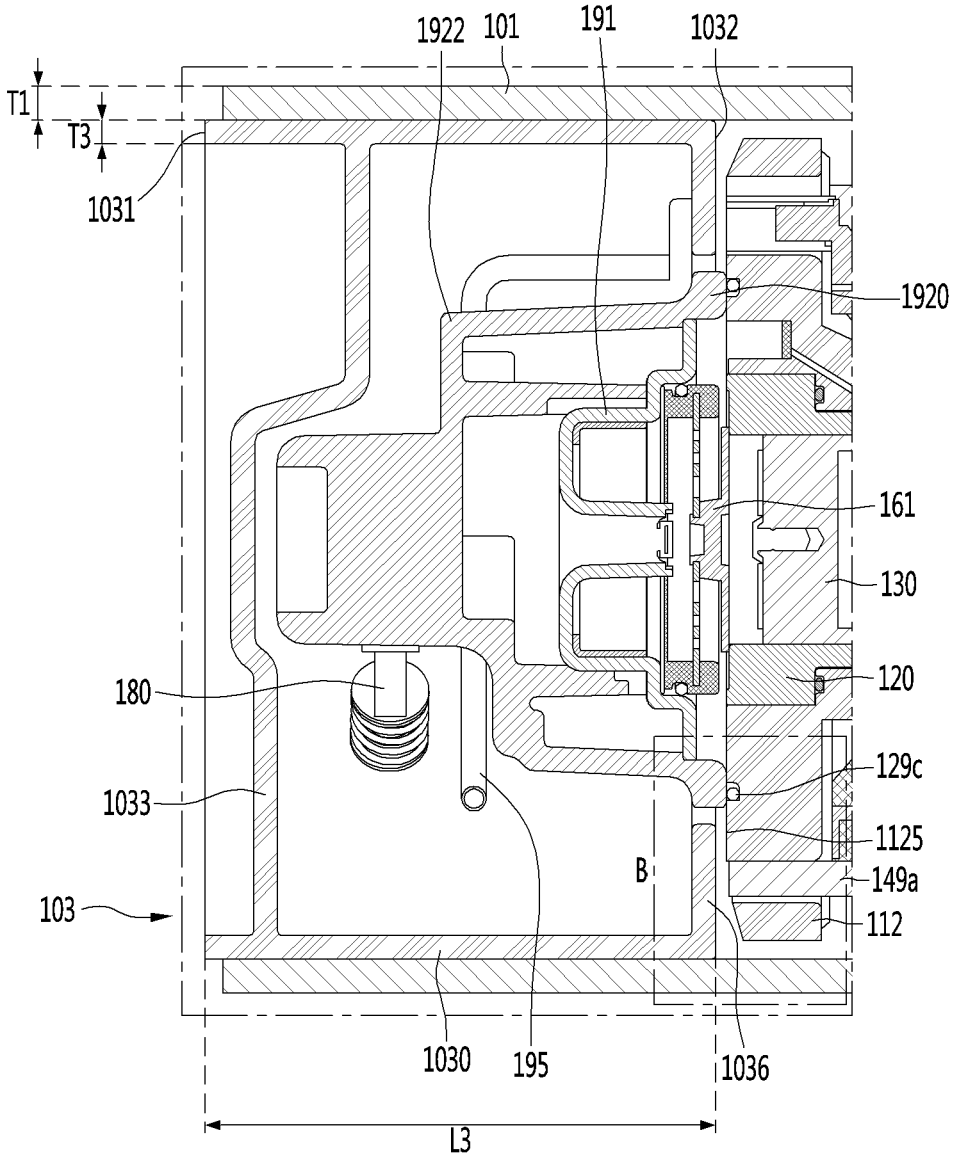
FIG. 7 is a view illustrating a portion A of FIG. 6.

FIG. 7 is a view illustrating a portion A of FIG. 6.

As illustrated in FIG. 7, the discharge shell cover 103 may be disposed adjacent to the frame 110. In detail, the discharge shell cover 103 extends to be adjacent to the front surface of the frame flange 112. Here, the front surface of the frame flange 112 may be referred to as a frame heat-exchange surface 1125.

As described above, the discharge shell cover 103 has a discharge shell length L3 corresponding to a relatively long length in the axial direction. For example, the discharge shell length L3 may be provided to be 2 times or more of the suction shell length L2 (L3>L2*2) and provided to be 0.25 times or more of the shell body length L1 (L3>L1*0.25). Such a value corresponds to a very long length as compared with the conventional linear compressor.

That is, the discharge shell length L3 of the linear compressor 10 according to an embodiment may have a very long length. Particularly, since the portion of the discharge shell cover 103, which is exposed to the outside, is the same, a portion at which the discharge shell cover 103 overlaps the shell body 101 is long.

Here, a thickness of the overlapping portion of the discharge shell cover 103 and the shell body 101 corresponds to the sum of the discharge shell thickness T3 and the shell body thickness T1 (T3+T1). That is, at least a portion of the shell 101, 102, and 103 may be relatively thick.

Accordingly, the shell 101, 102, and 103 may be reinforced in rigidity, and the natural frequency may increases. Also, a shell surface acceleration may be reduced, and noise may be reduced. In detail, the vibration of the compressor body may not be well transmitted to the outside by the shell 101, 102, and 103.

Also, as described above, the discharge shell length L3 may correspond to a axial distance between the frame heat-exchange surface 1125 and the outer end 1031 of the discharge shell cover 103. In detail, the discharge shell length L3 may be slightly less than the axial distance between the frame heat-exchange surface 1125 and the outer end 1031 of the discharge shell cover 103.

The inner end of the discharge shell cover 103 is spaced a predetermined distance from the frame heat-exchange surface 1125. For example, the spaced distance may be less than the discharge shell thickness T3 of the discharge shell cover 103.

Thus, the discharge shell cover 103 may serve as a stopper for the frame 110. In detail, a moving distance of the frame 110 may be limited by a distance spaced apart from the discharge shell cover 103. For example, when the linear compressor 10 moves, the compressor body may be shaken due to an external impact or the like. Here, the frame 110 may contact the discharge shell cover 103 so as not to vibrate any longer.

Here, the inner end of the discharge shell cover 103 corresponds to the third portion 1036. Thus, the third portion 1036 and the frame heat-exchange surface 1125 are spaced a predetermined distance from each other. That is to say, a predetermined passage may be provided between the third portion 1036 and the frame heat-exchange surface 1125. This will be described in detail later.

Figure 8:
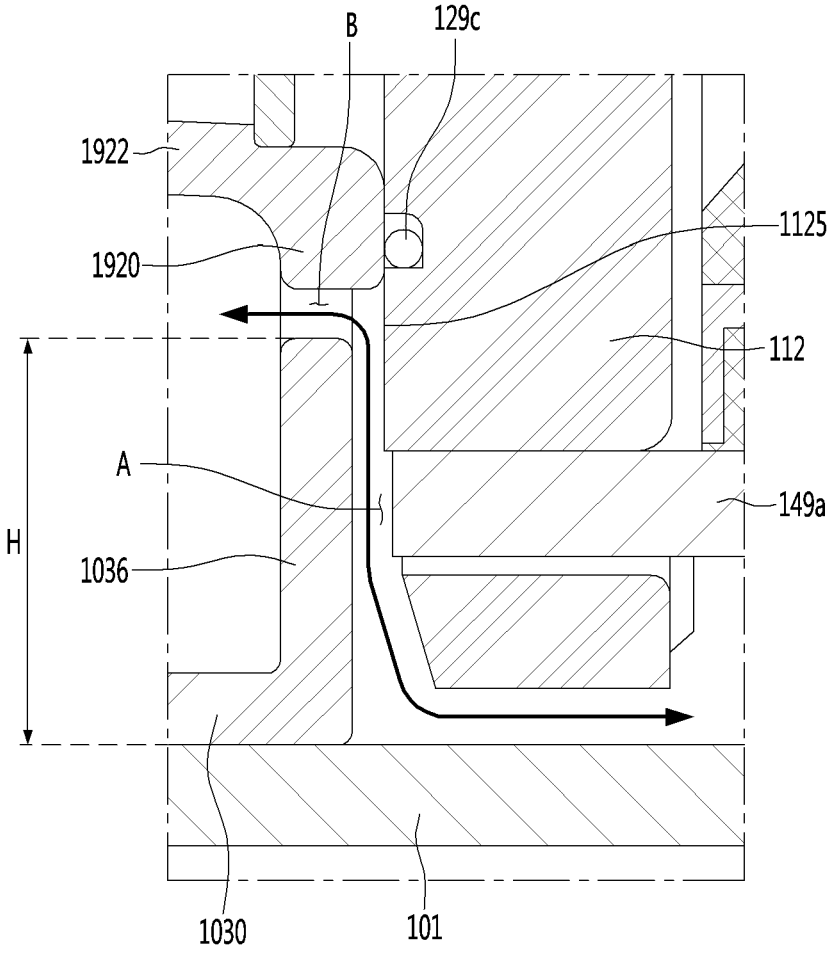
FIG. 8 is a view illustrating a flow of a refrigerant together in addition to a portion B in FIG. 7.

FIG. 8 is a view illustrating a flow of a refrigerant together in addition to a portion B in FIG. 7.

As illustrated in FIG. 8, a first passage A is provided between the third portion 1036 and the frame heat-exchange surface 1125. As described above, the first passage A is provided so that the inner end of the discharge shell cover 103 and the frame heat-exchange surface 1125 are spaced apart from each other. Here, the first passage A may have a width less than the discharge shell thickness T3 of the discharge shell cover 103.

Also, the third portion 1036 extends in the radial direction. In detail, the third portion 1036 extends by a passage length H in the radial direction. Here, the passage length H means a length in which the third portion 1306 maximally extends in the radial direction.

Here, the third portion 1036 is spaced a predetermined distance from the discharge cover 192. In detail, the third portion 1036 is disposed in the same line with the cover flange part 1920 in the radial direction and spaced a predetermined distance from the cover flange part 1920. For example, the third portion 1036 may extend in the radial direction along a plane defined by the cover flange part 1920. That is to say, the discharge shell opening 103*a* is disposed outside the cover flange part 1920 in the radial direction.

As described above, a second passage B communicating with the first passage A is provided between the third portion 1036 and the cover flange part 1920. In detail, the first passage A extends in the radial direction, and the second passage B extends in the axial direction.

Also, the second passage B may be understood as a portion of the discharge shell opening 103*a*. Here, the second passage B may have a width less than the discharge shell thickness T3.

Also, each of the first passage A and the second passage may have a width less than a distance between the outer surface of the frame flange 112 and the inner surface of the shell body 101.

That is, each of the first passage A and the second passage B may have a very small width. Thus, the refrigerant flowing through the first passage A and the second passage B may increase in flow rate, and the heat radiation of the frame 110 may effectively occur.

In detail, the refrigerant accommodated in the shell 101, 102, and 103 may flow due to the reciprocating movement of the piston 130. Here, the refrigerant may flow the front and rear sides of the frame flange 112 through the first passage A and the second passage B.

For example, the refrigerant may flow from the outer surface of the frame flange 112 toward the discharge cover 192 through the first passage A and the second passage B. Also, the refrigerant may flow from the outside of the discharge cover 192 to the outer surface of the frame flange 112 through the second passage B and the first passage A.

Here, since each of the first passage A and the second passage B has a narrow width, the flow rate of the refrigerant in the first passage A and the second passage B may increase so that the same amount of refrigerant flows. Here, since a convective heat transfer coefficient is proportional to the flow rate, a convective heat transfer amount increases as the flow rate increases. That is, an amount of heat convected by the refrigerant in the frame flange 112 may increase, and the heat of the frame 110 may be effectively dissipated.

Also, as the heat is effectively dissipated in the frame 110, heat transferred to the cylinder 120 and the piston 110 disposed inside the frame 110 is reduced. Thus, a temperature of the suction refrigerant is prevented from increasing, and the compression efficiency is improved.

Figure 9:
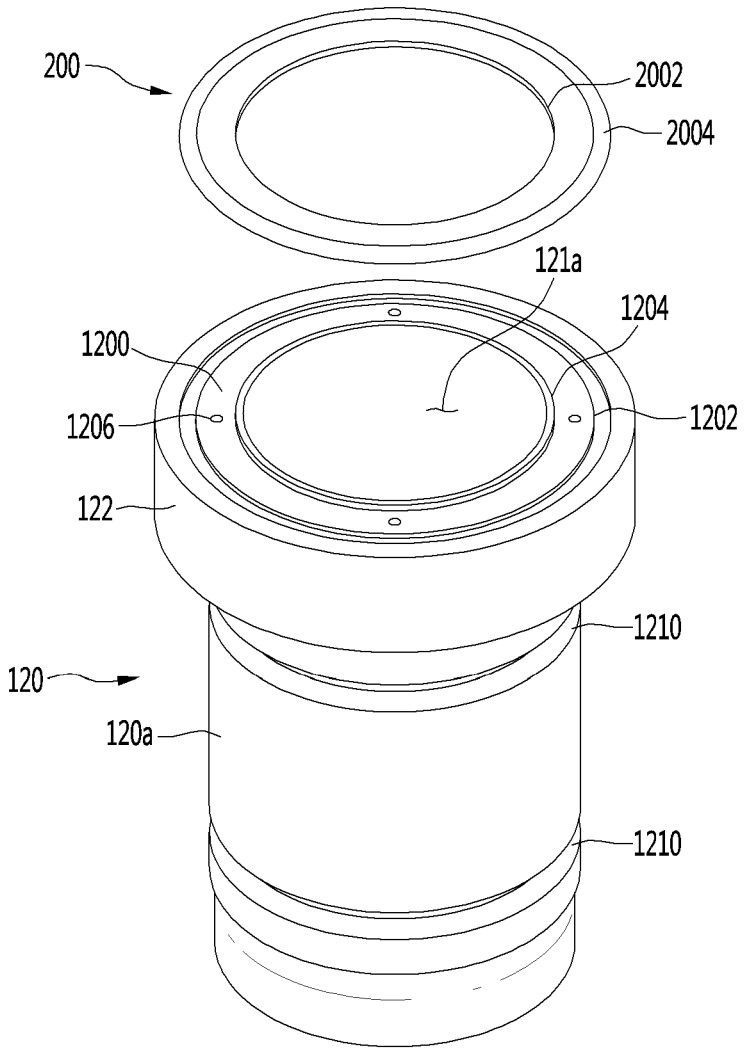
FIG. 9 is an exploded view illustrating a cylinder and an insulation member of a linear compressor according to a first embodiment.

FIG. 9 is an exploded view illustrating a cylinder and an insulation member of a linear compressor according to a first embodiment.

As illustrated in FIG. 9, a cylinder 120 includes a cylinder body 120*a* extending in the axial direction and a cylinder flange 122 extending outward from the cylinder body 120*a* in the radial direction. Here, the cylinder body 120*a* and the cylinder flange 122 may be integrated with each other.

The cylinder body 120*a* has a cylindrical shape of which upper and lower ends in the axial direction are opened. Also, a piston accommodation part 121*a* into which a piston 130 is accommodated is provided in the cylinder body 120*a*. In detail, a piston body 131 is accommodated in the piston accommodation part 121*a*.

Also, a portion of the piston accommodation part 121 may define a compression space P. In detail, a portion of the piston accommodation part 121*a*, which corresponds to a front side of the piston body 131, may be understood as the compression space P.

A gas inflow part 1210 into which a gas refrigerant flowing through a frame 110 is introduced is provided in the cylinder body 120*a*. The gas inflow part 1210 may be recessed inward from an outer circumferential surface of the cylinder body 120*a* in the radial direction. Particularly, the gas inflow part 1210 may be provided to have a smaller surface area in the radial direction. Thus, an inner end of the gas inflow part 1210 in the radial direction may provide a tip portion.

Also, the gas inflow part 1210 extends in the circumferential direction along an outer circumferential surface of the cylinder body 120*a* and has a circular shape. Also, the gas inflow part 1210 may be provided in plurality that are spaced apart from each other in the axial direction. For example, two gas inflow parts 1210 may be provided.

A cylinder filter member (not shown) may be installed on the gas inflow part 1210. The cylinder filter member (not shown) may prevent foreign substances having a predetermined size or more from being introduced into the cylinder 120. Also, the cylinder filter member performs a function of adsorbing an oil component contained in the refrigerant.

A cylinder sealing member insertion part 1212 into which a second sealing member 129*b* is inserted is defined in the cylinder body 120*a*. The cylinder sealing member insertion part 1212 may be recessed inward from the outer circumferential surface of the cylinder in the radial direction.

Also, the cylinder sealing member insertion part 1212 may be disposed behind the gas inflow part 1210. Thus, the second sealing member 129*b* may improve coupling force between the cylinder 120 and the frame 110 and also prevent the refrigerant from leaking to the rear side of the cylinder 120.

The cylinder flange 122 have a circular plate shape having a predetermined thickness in the axial direction. In detail, the cylinder flange 122 is provided in a ring shape having a predetermined thickness in the axial direction due to the piston accommodating part 121*a* provided at a central side in the radial direction.

Particularly, the cylinder flange 122 extends from a front end of the cylinder body 120*a* in the radial direction. The first sealing member 129*a* is disposed at a rear side of the cylinder flange 122.

The first sealing member may be disposed between the frame 110 and the cylinder 120 so that the coupling force between the frame 110 and the cylinder 120 increases. Also, as described above, a frame 110 may be installed on the first sealing member 129*a*.

Here, the front surface of the cylinder may be disposed in the same line as the front surface of the frame 110 in the radial direction. That is, the cylinder 120 is inserted into the frame 110 as a whole. Hereinafter, the front surface of the cylinder 120 is referred to as a discharge cylinder surface 1200.

It is understood that the discharge cylinder surface 1200 defines the rear side of the discharge space D together with the front surface of the frame 110. In detail, the discharge cylinder surface 1200 is disposed in an inner space defined by coupling the frame 110 to the discharge cover 191. That is, a high-temperature refrigerant may flow through the discharge cylinder surface 1200.

Also, a discharge valve 161 and an insulation member 200 may be seated on the discharge cylinder surface 1200. Particularly, the insulation member 200 may be seated on the discharge cylinder surface 1200 so as to reduce a contact area between the discharge cylinder surface 1200 and the high-temperature refrigerant.

Also, the discharge cylinder surface 1200 is provided in a ring shape extending in the radial direction as a whole. That is, the discharge cylinder surface 1200 is provided in a ring shape having an inner diameter and an outer diameter. Here, an opening defined in the central side of the discharge cylinder surface 1200, i.e., the inner diameter is defined by the piston accommodating part 121*a*.

A cylinder insulation seating part 1202 on which at least a portion of the insulation member 200 is seated is disposed on the discharge cylinder surface 1200. The cylinder insulation seating part 1202 may be recessed from the discharge cylinder surface 1200. In detail, the cylinder insulation seating part 1202 is recessed backward from the discharge cylinder surface 1200 in the axial direction.

Also, the cylinder insulation seating part 1202 may be disposed at the center side of the discharge cylinder surface 1200 in the radial direction. In detail, the cylinder insulation seating part 1202 may extend in the circumferential direction and may be recessed in a ring shape as a whole. Also, the cylinder insulation seating part 1202 has a diameter greater than the inner diameter of the discharge cylinder surface 1200 and less than the outer diameter of the discharge cylinder surface 1200.

As described above, the numerical value of the cylinder insulation seating part 1202, for example, a depth recessed backward in the axial direction may be changed depending on the design. Also, the cylinder insulation seating part 1202 may be omitted if necessary.

Also, a discharge valve seating part 1204 on which at least a portion of the discharge valve 61 is seated is disposed on the discharge cylinder surface 1200. The discharge valve seating part 1204 may protrude from the discharge cylinder surface 1200. In detail, the discharge valve seating part 1204 may protrude forward from the discharge cylinder surface 1200 in the axial direction.

Also, the discharge valve seating part 1204 may be disposed an inner end in the radial direction. In detail, the discharge valve seating part 1204 may extend in the circumferential direction and may protrude in a ring shape as a whole. Also, the discharge valve seating part 1204 may have the same inner diameter as the discharge cylinder surface 1200.

As described above, the numerical value of the discharge valve seating part 1204, for example, a height protruding forward in the axial direction may be changed depending on the design. Also, the discharge valve seating part 1204 may be omitted if necessary.

As described above, the discharge cylinder surface 1200 may be stepped in the axial direction. In detail, the discharge cylinder surface 1200 protrudes in the axial direction from the discharge valve seating part 1204, and the cylinder insulation seating part 1202 is recessed to be stepped in three stages. Also, the discharge valve seating part 1204 is disposed at the innermost side in the radial direction.

Also, an insulation member fixing part 1206 may be disposed on the discharge cylinder surface 1200. The insulation member fixing part 1206 is disposed between the discharge valve seating part 1204 and the cylinder insulation seating part 1202 in the radial direction.

The insulation member fixing part 1206 may be recessed from the discharge cylinder surface 1200. In detail, the insulation member fixing part 1206 may be recessed backward in the axial direction and provided in plurality spaced apart from each other in the circumferential direction. Here, an insulation member protrusion (not shown) inserted into the insulation member fixing part 1206 may be disposed on the insulation member 200.

Thus, at least a portion of the insulation member 200 may be inserted into the insulation member fixing part 1206. Thus, rotation of the insulation member 200 in the circumferential direction may be prevented. In FIG. 9, the four insulation member fixing part 1206 are recessed in the circular shape and spaced part from each other in the circumferential direction, but this is merely exemplary.

The insulation member 200 may have an inner diameter and an outer diameter and have a ring shape that extends in the radial direction. Here, the insulation member 200 includes a first insulation part 2002 and a second insulation part 2004.

The first insulation part 2002 may have a circular opening corresponding to the inner diameter. The first insulation part 2002 may be disposed to contact the discharge valve seating part 1204 in the radial direction. That is to say, the outer diameter of the discharge valve seating part 1204 and the inner diameter of the insulation member 200 may be the same.

Also, a length of the first insulation part 2002 in the axial direction may be the same as the protruding height of the discharge valve seating part 1204 in the axial direction. Thus, top surfaces of the first insulation part 2002 and the discharge valve seating part 1204 in the axial direction may be disposed in the same line.

Also, the discharge valve 161 is seated on the top surfaces of the first insulation part 2002 and the discharge valve seating part 1204 in the axial direction. That is, at least a portion of the discharge valve may be disposed to contact the insulation member 200.

The second insulation part 2004 is disposed outside the first insulation part 2002 in the radial direction. That is, the insulation member 200 extends outward from the first insulation part 2002 to the second insulation part 2004 in the radial direction. Also, the second insulation part 2004 may be seated on the cylinder insulation seating part 1202.

Also, a length of the second insulation part 2004 in the axial direction may be greater than that of the first insulation part 2002 in the axial direction. Furthermore, the length of the second insulation part 2004 in the axial direction may be greater than the recessed depth of the cylinder insulation seating part 1202 in the axial direction.

Thus, when the second insulation part 2004 is seated on the cylinder insulation part 1202, at least a portion of the second insulation part 2004 may protrude from the discharge cylinder surface 1200 in the axial direction.

Here, the discharge valve assembly 160 is disposed above the second insulation part 2004 in the axial direction. In detail, the second insulation part 2004 is disposed between the cylinder insulation seating part 1202 and the spring support part 165.

Particularly, the second insulation part 2004 may be made of a material having elasticity and may contact the cylinder insulation seating part 1202 and the spring support part 165. Thus, the refrigerant may be prevented from leaking between the discharge cylinder surface 1200 and the spring support part 165.

Also, the second insulation part 2004 may define a circular outer appearance corresponding to the outer diameter. That is, the insulation member 200 extends outward from the first insulation part 2002 to the second insulation part 2004 in the radial direction.

Also, the outer diameter of the insulation member 200 may correspond to the diameter of the cylinder insulation seating part 1202. Here, the correspondence means that the outer diameter of the insulation member 200 is less than the outer diameter of the cylinder insulation seating part 1202 and larger than the inner diameter of the cylinder insulation seating part 1202.

As described above, the insulation member 200 is provided to cover most of the discharge cylinder surface 1200. Here, a portion of the discharge cylinder surface 1200 disposed outside the insulation member 200 in the radial direction may be blocked in flow of the discharge refrigerant by the insulation outer end to prevent heat from being transferred.

Also, the insulation member 200 may be made of a material having a low heat transfer coefficient. For example, the insulation member 200 may be made of plastic or a material that is coated with a thermal blocking material. Thus, the transferring of the heat of the refrigerant discharged from the compression space P to the discharge cylinder surface 1200 may be minimized.

An operation of the linear compressor 10 will be described based on the above structure.

Figure 10A:
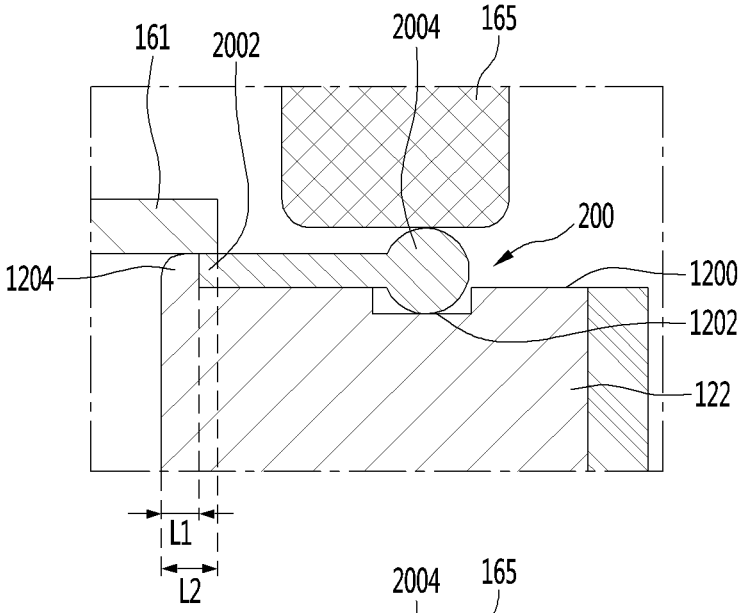
FIGS. 10A to 10C are enlarged views illustrating the insulation member of the linear compressor according to the first embodiment.
Figure 10B:
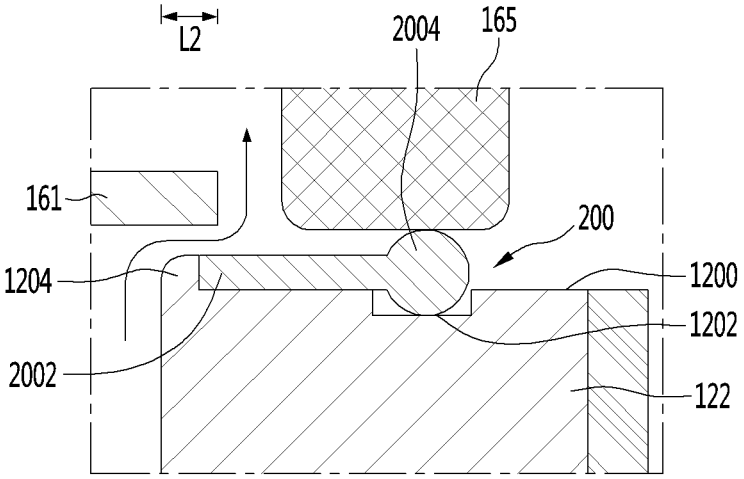
Figure 10C:
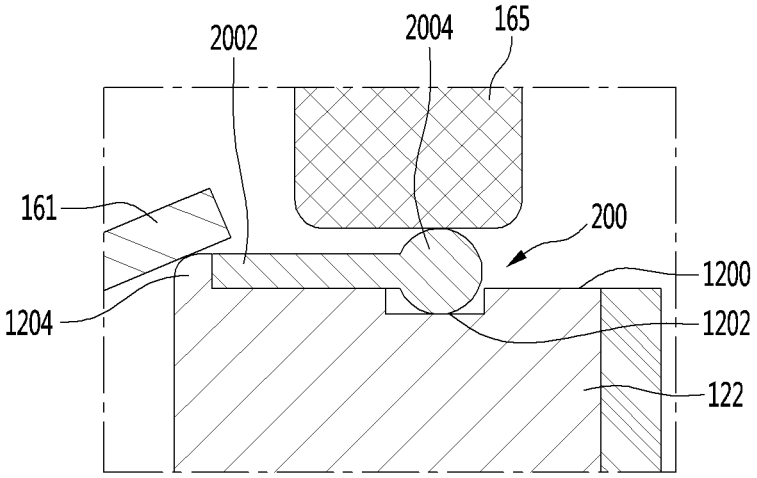

FIGS. 10A to 10C are enlarged views illustrating the insulation member of the linear compressor according to the first embodiment. For convenience of description, FIGS. 10A to 10C illustrate the insulation member 200 and peripheral constituents of the insulation member 200.

FIGS. 10A to 10C illustrate movement of the discharge valve 161 depending on the driving of the linear compressor 10. Particularly, movement of the discharge valve 161 according to a relative pressure between the compression space P and the discharge space D is illustrated. However, this illustrates schematic condition and movement for convenience of description, but are not limited thereto.

In detail, FIG. 10A illustrates a case in which the pressures of the compression space P and the discharge spaces D are similar to each other, and FIG. 10B illustrates a case in which the pressure of the compression space P is high. Also, FIG. 10C illustrates a case in which the pressure of the discharge space D is high.

As illustrated in FIGS. 10A to 10C, the outside of the discharge valve in the radial direction is seated on the discharge valve seating part 1204. Here, a length of the discharge valve seating part 1204 in the radial direction is referred to as a seating part length L1.

Also, as described above, the discharge valve seating part 1204 is disposed inside the discharge cylinder surface 1200 in the radial direction, and the insulation member 200 contacts the outside of the discharge valve seating part 1204 in the radial direction. Thus, the seating part length L1 may be calculated by subtracting an inner radius of the discharge cylinder surface 1200 from an inner radius of the insulation member 200.

Also, a length by which the discharge valve 161 and the discharge cylinder surface 1200 overlap each other in the radial direction is referred to as a valve length L2. The valve length L2 may be calculated by subtracting the inner radius of the discharge cylinder surface 1200 from the outer radius of the discharge valve 161.

In detail, an outer end of the discharge valve 161 extends further from the discharge valve seating part 1204 in the radial direction. Thus, the valve length L2 is greater than the seating part length L1 ($L1<L2$).

Also, as described above, the first insulation part 2002 may be disposed in the same line as the top surface of the discharge valve seating part 1204 in the axial direction.

Thus, the discharge valve 161 may be disposed to contact at least a portion of the insulation member 200. A contact length between the discharge valve 161 and the insulation member 200 in the radial direction corresponds to a value obtained by subtracting the seating part length L1 from the valve length L2.

Here, the valve length L2 corresponds to a length for allowing the discharge valve 161 to be stably installed. The valve length L2 is assumed to be a fixed value.

The seating part length L1 corresponds to the inner length of the discharge cylinder surface 1200, which does not contact the heat insulating member 200, in the radial direction. The discharge cylinder surface 1200 may be more exposed to the discharge refrigerant as the seating part length L1 increases. That is, the heat of the discharge refrigerant may be more transferred to the discharge cylinder surface 1200.

As the seating part length L1 decreases, the contact length between the discharge valve 161 and the insulation member 200 increases. Thus, a relatively large amount of external force may be applied to the insulation member 200 according to the movement of the discharge valve 161. Thus, the insulation member 200 may be damaged.

Thus, the seating part length L1 has to be properly set. For example, the seating part length L1 may be greater than 0.7 times the valve length L2 ($0.7*L2<L1<L2$). The length may be determined experimentally and be calculated differently depending on external conditions.

As illustrated in FIG. 10A, when the pressure of the compression space P and the pressure of the discharge space D are similar to each other, the discharge valve 161 is seated on the discharge cylinder surface 1200 in parallel to the radial direction. For example, this may correspond to a case in which the compression space P is closed, and the refrigerant is compressed.

Here, in the axial direction of the discharge valve 161, a high-temperature discharge refrigerant compressed in the compression space P exists. Here, the heat of the discharge refrigerant may not be directly transferred to the discharge cylinder surface 1200 by the insulation member 200. That is, the insulation member 200 may cover the discharge cylinder surface 1200 to prevent the discharge cylinder surface 1200 from being exposed to the discharge refrigerant.

Also, the second insulation part 2004 may prevent the discharge refrigerant from flowing outward in the radial direction. Thus, the heat is not directly transferred to the outer end of the discharge cylinder surface 200, in which the insulation member 200 is not provided, by the discharge refrigerant.

As illustrated in FIG. 10B, when the pressure of the compression space (P) is high, the discharge valve 161 is spaced forward from the discharge cylinder surface 1200 in the axial direction. For example, the compression is completed by the piston 130, and then, the compression space P is opened by the discharge valve 161, and thus, the compressed refrigerant is discharged.

The discharge refrigerant flows from the compression space P to the discharge space D as shown by an arrow in FIG. 10B. Here, most of the discharge cylinder surfaces 1200 is not exposed to the discharge refrigerant by the insulation member 200. That is, the heat of the discharge refrigerant may be prevented from being transferred to the discharge cylinder surface 1200.

As illustrated in FIG. 10C, when the pressure of the discharge space D is high, the discharge valve 161 moves backward toward the discharge cylinder surface 1200 in the axial direction. For example, the refrigerant flows into the compression space P when the compression space P is opened by the suction valve 135.

The discharge valve 161 moves backward in the axial direction to contact the discharge cylinder surface 1200. The outside of the discharge valve 161 in the radial direction contacts the discharge cylinder surface 1200 to restrict the movement in the axial direction. Also, the central side of the discharge valve 161 further protrudes backward in the axial direction by the pressure of the refrigerant. Thus, the central side may convexly protrude in the axial direction as a whole so as to be provided in a bent shape.

In this process, an impact is applied to the discharge cylinder surface 1200 by the movement of the discharge valve 161. Here, since the outer end of the discharge valve 161 is disposed in an inclined state, the discharge valve 161 may contact only the discharge valve seating part 1204.

That is, the discharge valve 161 may not contact the insulation member 200. Thus, the external force due to the impact may not be applied to the insulation member 200. Thus, the insulation member 200 may be prevented from being damaged.

The insulation member 200 seated on the cylinder 120 has been described above. As described above, the heat of the discharge refrigerant may be prevented from being transmitted to the cylinder 120 by the insulation member 200.

Here, the heat may also be transferred to the frame 110 accommodating the cylinder 120 by the discharge refrigerant. Thus, the insulation member according to the embodiment is seated on the cylinder 120 and the frame 110 to prevent the heat of the discharge refrigerant from being transferred.

Figure 11:
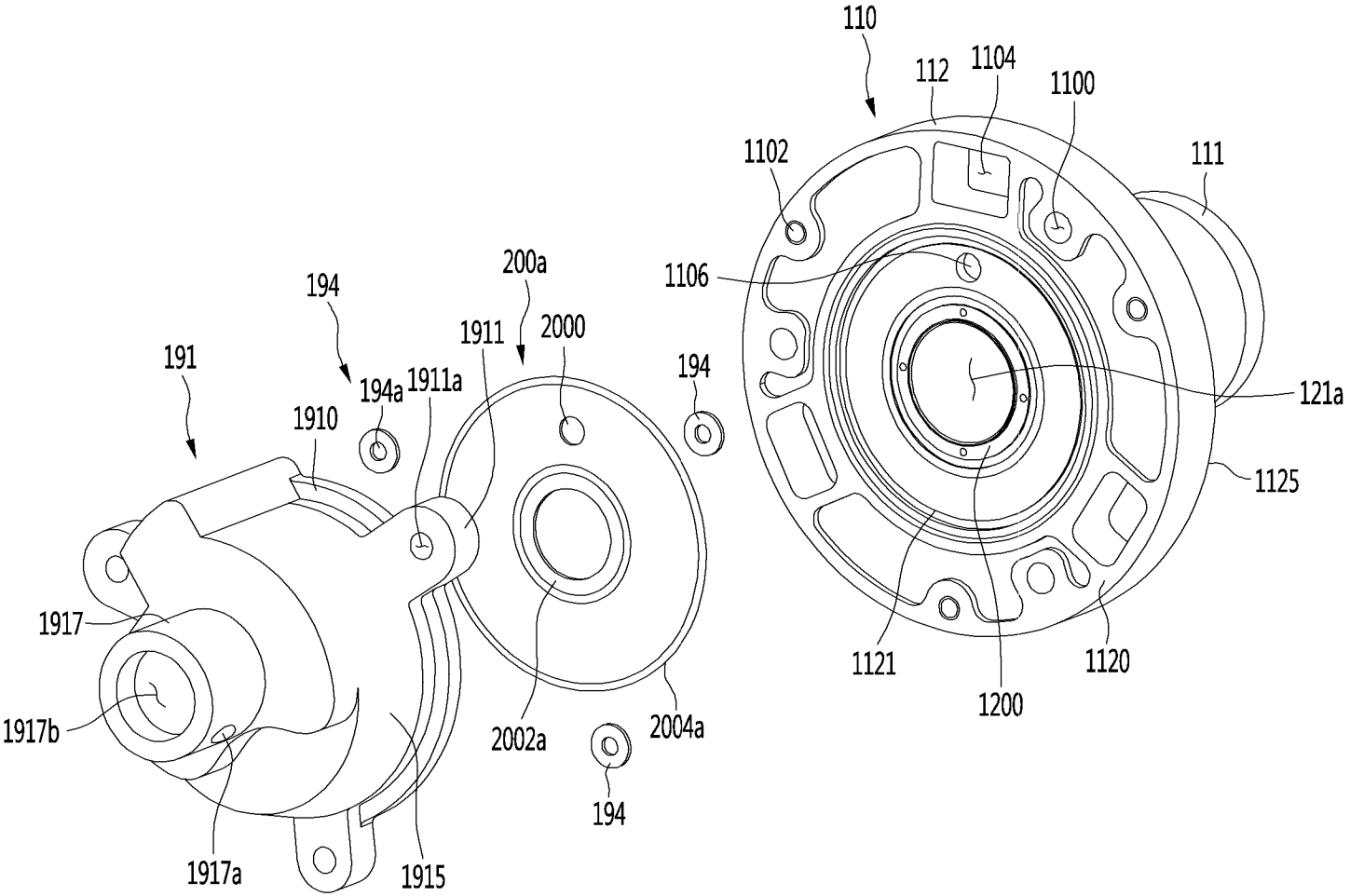
FIG. 11 is an exploded view illustrating a discharge unit, a frame, a cylinder, and an insulation member of a linear compressor according to a second embodiment.
Figure 12:
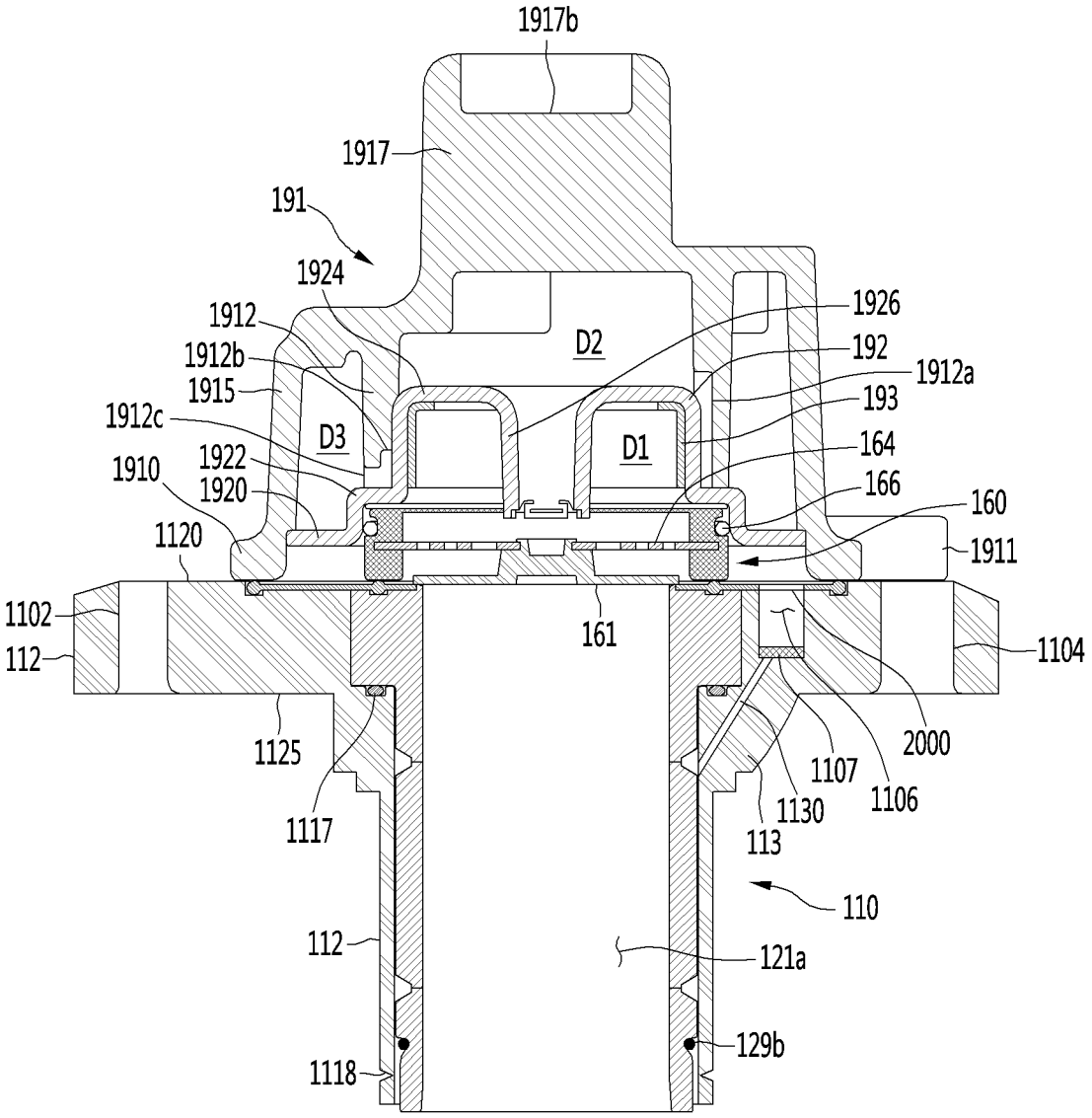
FIG. 12 is a view illustrating a coupled cross-section of the discharge unit, the frame, the cylinder, and the insulation member of the linear compressor according to the second embodiment.
Figure 13:
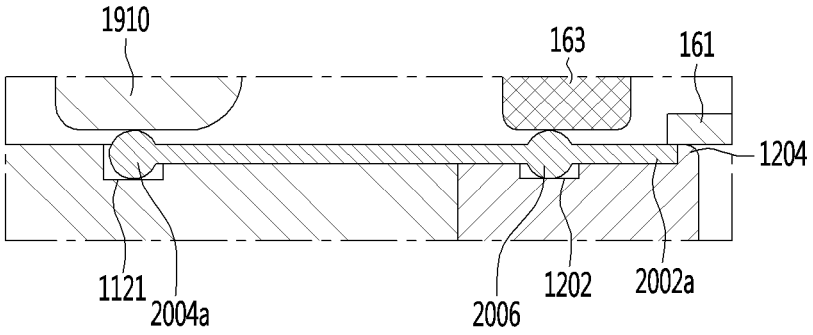
FIG. 13 is an enlarged view illustrating the insulation member of the linear compressor according to the second embodiment.

For convenience of description, FIGS. 9 and 10 illustrates the linear compressor according to the first embodiment, and FIGS. 11 to 13 illustrates a linear compressor according to a second embodiment. Here, the linear compressors according to the first and second embodiments have the same configuration except for the insulation member, the cylinder 120 on which the insulation member is seated, and the front surface of the frame 110.

Thus, the same reference numerals are used, duplicated description will be omitted, and the above description is derived. In the case of the similar configuration, the reference numerals are denoted by "a", and the differences will be described. Hereinafter, an insulation member 200*a* of the linear compressor according to the second embodiment will be described.

FIG. 11 is an exploded view illustrating a discharge unit, a frame, a cylinder, and an insulation member of a linear compressor according to a second embodiment, FIG. 12 is a view illustrating a coupled cross-section of the discharge unit, the frame, the cylinder, and the insulation member of the linear compressor according to the second embodiment. Also, FIG. 13 is an enlarged view illustrating the insulation member of the linear compressor according to the second embodiment.

Referring to FIGS. 11 and 12, a frame 110 and a discharge unit 190 will be described in detail. The constituents will be commonly applied to all the linear compressors according to the first and second embodiments.

As illustrated in FIGS. 11 and 12, the discharge unit 190 and the frame 110 may be coupled to each other a predetermined coupling member (not shown). Particularly, the discharge unit 190 and the frame 110 may be coupled to each other at three points.

The frame 110 includes a frame body 111 extending in the axial direction and a frame flange 112 extending outward from the frame body 111 in the radial direction. Here, the frame body 111 and the frame flange 112 may be integrated with each other.

The frame body 111 has a cylindrical shape of which upper and lower ends in the axial direction are opened. Also, a cylinder accommodation part (not shown) into which a cylinder 120 is accommodated is provided in the frame body 111. Thus, the cylinder 120 is accommodated in the frame body 111 in the radial direction, and at least a part of the piston 130 is accommodated in the cylinder 120 in the radial direction.

Also, sealing member insertion parts 1117 and 1118 are disposed on the frame body 111. The sealing member insertion parts include a first sealing member insertion part 1117 which is provided inside the frame body 111 and into which a first sealing member 129*a* is inserted. Also, the sealing member insertion parts include a third sealing member insertion part 1118 which is provided on an outer circumferential surface of the frame body 111 and into which a third sealing member 129*a* is inserted.

Also, an inner stator 148 is coupled to the outside of the frame body 111 in the radial direction. The outer stator 141 is disposed outward the inner stator 148 in the radial direction, and a permanent magnet 146 is disposed between the inner stator 148 and an outer stator 141.

The frame flange 112 have a circular plate shape having a predetermined thickness in the axial direction. In detail, the frame flange 112 is provided in a ring shape having a predetermined thickness in the axial direction due to a cylinder accommodating part (not shown) provided at a central side in the radial direction.

Particularly, the frame flange 112 extends from a front end of the frame body 111 in the radial direction. Thus, the inner stator 148, the permanent magnet 146, and the outer stator 141, which are disposed outside the frame body 111 in the radial direction, may be disposed at a rear side of the frame flange 112 in the axial direction.

Also, a plurality of openings passing in the axial direction are defined in the frame flange 112. Here, the plurality of openings include a discharge coupling hole 1100, a stator coupling hole 1102, and a terminal insertion hole 1104.

A predetermined coupling member (not shown) for coupling the discharge cover 191 to the frame 110 is inserted into the discharge coupling hole 1100. In detail, the coupling member (not shown) may be inserted to a front side of the frame 110 by passing through a discharge cover 191.

The above-described cover coupling member 149*a* that is described above is inserted into the stator coupling hole 1102. The cover coupling member 149*a* may the stator cover 149 to the frame 110 to fix the outer stator 114 disposed between the stator cover 149 and the frame 110 in the axial direction.

The above-described terminal part 141*d* of the outer stator 141 may be inserted into the terminal insertion part 1104. That is, the terminal part 141*d* may be withdrawn or exposed to the outside through the terminal insertion hole 1104 by passing from the rear side to the front side of the frame 110.

Here, each of the discharge coupling hole 1100, the stator coupling hole 1102, and the terminal insertion hole 1104 may be provided in plurality, which are sequentially disposed spaced apart from each other in the circumferential direction. For example, each of the discharge coupling hole 1100, the stator coupling hole 1102, and the terminal insertion hole 1104 may be provided in three, which are sequentially disposed at an angle of about 120 degrees in the circumferential direction.

Also, the terminal insertion holes 1104, the discharge coupling holes 1100, and the stator coupling holes 1102 are sequentially disposed to be spaced apart from each other in the circumferential direction. Also, the openings adjacent to each other may be disposed to be spaced an angle of about 30 degrees from each other in the circumferential direction.

For example, the respective terminal insertion holes 1104 and the respective discharge coupling holes 1100 are disposed spaced an angle of about 30 degrees from each other in the circumferential direction. Also, the respective discharge coupling holes 1100 and the respective stator coupling holes 1102 are disposed to be spaced an angle of about 30 degrees from each other in the circumferential direction. For example, the respective terminal insertion holes 1104 and the respective stator coupling holes 1102 are disposed spaced an angle of about 60 degrees from each other in the circumferential direction.

Also, the terminal insertion holes 1104, the discharge coupling holes 1100, and the stator coupling holes 1102 are arranged based on a center of the circumferential direction.

Here, a front surface of the frame flange 112 is referred to as a discharge frame surface 1120, and a rear surface thereof is referred to as a motor frame surface 1125. That is, the discharge frame surface 1120 and the motor frame surface 1125 correspond to surfaces opposite to each other in the axial direction. In detail, the discharge frame surface 1120 corresponds to a surface contacting the discharge cover 191. Also, the motor frame surface 1125 corresponds to a surface that is adjacent to the motor assembly 140.

Also, the above-described gas hole 1106 is defined in the discharge frame surface 1120. The gas hole 1106 is recessed backward from the discharge frame surface 1120 in the axial direction. Also, a gas filter 1107 for filtering foreign substances contained in the flowing gas may be mounted on the gas hole 1106.

Also, referring to FIG. 11, a predetermined recess structure may be provided in the discharge frame surface 1120. This is done for preventing heat of the discharge refrigerant from being transferred, and the recess structure is not limited in recessed depth and shape.

As described above, the discharge unit 190 includes a discharge cover 191, a discharge plenum 192, and a fixing ring 193. The discharge cover 191, and the discharge plenum 192, and the fixing ring 193 may be manufactured through different materials and methods.

Here, the discharge plenum 192 is coupled to the inside of the discharge cover 191, and the fixing ring 193 is coupled to the inside of the discharge plenum 192. Particularly, the discharge cover 191 and the discharge plenum 192 may be coupled to each other to define the plurality of discharge spaces D. The discharge space D may be understood as a space through which the refrigerant discharged from the compression space P flows.

The discharge cover 191 may be provided in a bowl shape as a whole. In detail, the discharge cover may have a shape which has one opened surface and an internal space. Particularly, a rear side of the discharge cover 191 in the axial direction may be opened.

The discharge cover 191 includes a cover flange part 1910 coupled to the frame 110, a chamber part 1915 extending forward from the cover flange part 1910 in the axial direction, and a support device fixing part 1917 extending forward from the chamber part 1915 in the axial direction.

The cover flange part 1910 contact the front surface of the frame 110. In detail, the cover flange part 1910 is disposed to contact the discharge frame surface 1120.

Also, the cover flange part 1910 has a predetermined thickness in the axial direction and extends in the radial direction. Thus, the cover flange part 1910 may be provided in a circular plate shape as a whole.

Here, the cover flange part 1910 is relatively small in comparison with a diameter of the discharge frame surface 1120. For example, the diameter of the cover flange part 1910 may be about 0.6 times to about 0.8 times of the diameter of the discharge frame surface 1120. In the linear compressor according to the related art, the diameter of the cover flange part is set to about 0.9 times or more of the diameter of the discharge frame surface.

The above-described structure is for minimizing the heat transferred from the cover flange part 1910 to the frame 110. In detail, the heat of the discharge cover 191 may be conducted to the frame 110 through the cover flange part 1910 as the cover flange part 1910 is disposed to contact the discharge frame surface 1120.

Here, since the thermal conductivity is proportional to the contact area, an amount of heat conducted according to the contact area between the cover flange part 1910 and the discharge frame surface 1120 may be changed. That is, the diameter of the cover flange part 1910 may be minimized to minimize the contact area with the discharge frame surface 1120. Thus, the amount of heat transferred to the frame 110 from the discharge cover 191 may be minimized.

Also, a heat dissipating member 200*a* to be described later is disposed between the discharge cover 191 and the discharge frame surface 1120. The heat transferred from the discharge cover 191 to the discharge frame 1120 may be substantially blocked.

As the contact area with the cover flange part 190 is reduced, a relatively large portion of the discharge frame surface 1120 may be exposed to the inside of the shell 101.

As described above, the surface exposed to the inside of the shell 101 contacts the refrigerant (hereinafter, referred to as a shell refrigerant) accommodated in the shell 101, and thus, heat transfer occurs. Particularly, since the shell refrigerant is provided at a temperature similar to that of the suction refrigerant, convention heat transfer is generated in the frame 110 from the shell refrigerant. Also, since the convection heat transfer is proportional to the contact area, the surface exposed to the inside of the shell 101 increases, an amount of heat to be dissipated may increase.

In summary, as the surface area of the cover flange part 1910 decreases, the heat conducted to the frame 110 may decrease. Also, the heat dissipation from the frame 110 to the shell refrigerant may be effectively generated.

Thus, the frame 110 may be maintained at a relatively low temperature. Thus, the heat transferred to the cylinder 120 and the piston 110 disposed inside the frame 110 is reduced. As a result, the temperature of the suction refrigerant is prevented from rising, and the compression efficiency is improved.

An opening communicating with an opened rear side in the axial direction is defined in a central portion of the cover flange part 1910. The discharge plenum 192 may be mounted inside the discharge cover 191 the opening. Also, the opening may be understood as an opening in which the discharge valve assembly 160 is installed.

Also, the cover flange part 1910 includes a flange coupling hole 1911*a* through which a coupling member (not shown) to be coupled to the frame 110 passes. The flange coupling holes 1911*a* pass in the axial direction and is provided in plurality.

The flange coupling hole 1911*a* may have a size, a number, and a position corresponding to those of a discharge coupling hole 1100. The flange coupling holes 1911*a* may be provided in three positions spaced an angle of about 120 degrees from each other in the circumferential direction.

The discharge cover 191 includes a cover coupling part 1911 protruding from the cover flange portion 1910 in the radial direction to define the flange coupling hole 1911*a*. That is, the flange coupling hole 1911*a* is disposed outward from the cover flange part 1910*a* in the radial direction. The discharge coupling hole 1100 may be disposed outward from the cover flange portion 1910*a* in the radial direction.

The cover coupling part 1911 may be provided at three positions spaced an angle of about 120 degrees from each other in the circumferential direction corresponding to the flange coupling hole 1911*a*. Also, an edge of the cover coupling part 1911 may have a thickness greater than that of the cover flange part 1910 in the axial direction. It may be understood that the flange coupling hole 1911*a* is a portion to be coupled by the coupling member and is prevented from being damaged because relatively large external force is applied.

Each of the chamber part 1915 and the support device fixing part 1917 may have a cylindrical outer appearance. In detail, each of the chamber part 1915 and the support device fixing part 1917 has a predetermined outer diameter in the radial direction and extends in the axial direction. The outer diameter of the support device fixing part 1917 is less than the outer diameter of the chamber part 1915.

Also, the outer diameter of the chamber part 1915 is less than the outer diameter of the cover flange part 1910. That is, the discharge cover 191 may be stepped so that the outer diameter gradually decreases in the axial direction.

Also, the chamber part 1915 and the support device fixing part 1917 are provided in a shape of which a rear side in the axial direction is opened. Thus, each of the chamber part 1915 and the support device fixing portion 1917 may have an outer appearance defined by a cylindrical side surface and a cylindrical front surface.

The chamber part 1915 may further include a pipe coupling part (not shown) to which the cover pipe 195 is coupled. Particularly, the cover pipe 195 may be coupled to the chamber part 1915 to communicate with one of the plurality of discharge spaces D. The cover pipe 195 may communicate with the discharge space D through which the refrigerant finally passes.

At least a portion of a top surface of the chamber part 1915 may be recessed to avoid interference with the cover pipe 195. When the cover pipe 195 is coupled to the chamber part 1915, the cover pipe 195 may be prevented from contacting the front surface of the chamber part 1915.

Fixed coupling parts 1917*a* and 1917*b* to which the above-described second support device 180 is coupled are disposed on the support device fixing part 1917. The fixed coupling part includes a first fixed coupling part 1917*a* to which the discharge support part 181 is coupled and a second fixed coupling part 1917*b* to which a discharge spring (not shown) is installed.

The first fixed coupling part 1917*a* may be recessed inward or penetrated from the outer surface of the support device fixing part 1917 in the radial direction. The first fixed coupling part 1917*a* is provided in a pair. The pair of first fixed coupling parts 1917*a* are spaced apart from each other in the circumferential direction to correspond to the pair of discharge support parts 181.

The second fixing part 1917*b* may be recessed backward from the front surface of the support device fixing part 1917 in the axial direction. Thus, at least a portion of the discharge spring (not shown) may be inserted into the second fixed coupling part 1917*b*.

Also, the discharge cover 191 includes a partition sleeve 1912 for partitioning the internal space. The partition sleeve 1912 may have a cylindrical shape extending backward from the top surface of the chamber part 1915 in the axial direction.

Also, an outer diameter of the partition sleeve 1912 is less than an inner diameter of the discharge cover 191. In detail, the partition sleeve 1912 is spaced apart from an inner surface of the discharge cover 191 in the radial direction so that a predetermined space is defined between the partition sleeve 1912 and the inner surface of the discharge cover 191.

The inner space of the discharge cover 191 may be divided into the inside and the outside in the radial direction by the partition sleeve 1912. Here, a first discharge chamber D1 and a second discharge chamber D2 are provided inside the partition sleeve 1912 in the radial direction. Also, a third discharge chamber D3 is provided outside the partition sleeve 1912 in the radial direction.

Also, the discharge plenum 192 may be inserted into the partition sleeve 1912. In detail, at least a portion of the discharge plenum 192 may contact the inner surface of the partition sleeve 1912 and be inserted into the partition sleeve 1912.

Also, the partition sleeve 1912 may have a first guide groove 1912*a*, a second guide groove 1912*b*, and a third guide groove 1912*c*.

The first guide groove 1912*a* may be recessed outward from an inner surface of the partition sleeve 1912 in the radial direction and may extend in the axial direction. Particularly, the first guide groove 1912*a* extends backward from the front side in the axial direction rather than the position at which the discharge plenum 192 is inserted.

The second guide groove 1912*b* may be recessed outward from the inner surface of the partition sleeve 1912 in the radial direction and extend in the circumferential direction. Particularly, the second guide groove 1912*b* is defined in the inner surface of the partition sleeve 1912, which contacts the discharge plenum 192. Also, the second guide groove 1912*b* may communicate with the first guide groove 1912*a*.

The third guide groove 1912*c* may be recessed forward from a rear end of the partition sleeve 1912 in the axial direction. Thus, the rear end of the partition sleeve 1912 may be stepped. Also, the third guide groove 1912*c* may communicate with the second guide groove 1912*b*.

That is, the third guide groove 1912*c* may be recessed up to a portion in which the second guide groove 1912*b* is defined. Also, the third guide groove 1912*c* and the first guide groove 1912*a* may be spaced apart from each other in the circumferential direction. For example, the third guide groove 1912*c* may be defined in a position facing the first guide groove 1912*a*, i.e., in a position spaced at an angle of about 180 degrees in the circumferential direction.

A time taken for the refrigerant flowing into the second guide groove 1912*b* to stay in the second guide groove 1912*b* may increase. Thus, pulsation noise of the refrigerant may be effectively reduced.

Here, the discharge cover 191 according to an embodiment may be integrally manufactured by aluminum die casting. Thus, unlike the discharge cover according to the related art, in the case of the discharge cover 191 according to an embodiment, a welding process may be omitted. Thus, the process of manufacturing the discharge cover 191 may be simplified, resulting in minimizing product defects, and the product cost may be reduced. Also, since there is no dimensional tolerance due to the welding, the refrigerant may be prevented from leaking.

The cover flange part 1910, the chamber part 1915, and the support device fixing part 1917, which are described above, are integrated with each other and may be understood as being divided for convenience of explanation.

The discharge plenum 192 includes a plenum flange 1920, a plenum seating part 1922, a plenum body 1924, and a plenum extension part 1926. Here, the discharge plenum 192 may be integrally made of engineering plastic. That is, each of the constituents of the discharge plenum 192 to be described later is distinguished for the convenience of explanation.

Also, the constituent of the discharge plenum 192 may have the same thickness. Thus, the plenum flange 1920, the plenum seating part 1922, the plenum body 1924, and the plenum extension part 1926 may extend to have the same thickness.

The plenum flange 1920 defines a bottom surface of the of the discharge plenum 192 in the axial direction. That is, the plenum flange 1920 is disposed at the lowermost position in the axial direction on the discharge plenum 192. The plenum flange 1920 has an axial thickness and may be provided in a ring shape extending in the radial direction.

Here, an outer diameter of the plenum flange 1920 corresponds to an inner diameter of the discharge cover 191. Here, the correspondence means the same or consideration of an assembly tolerance in the inner diameter of the discharge cover 191.

Particularly, the plenum flange 1920 functions to close the rear side of the third discharge chamber D3 in the axial direction. That is, as the plenum flange 1920 is seated inside the discharge cover 191, the refrigerant in the third discharge chamber D3 may be prevented from flowing backward in the axial direction.

Also, the inner diameter of the plenum flange 1920 corresponds to a size of the spring assembly 163. In detail, the plenum flange 1920 may extend inward in the radial direction so as to be adjacent the outer surface of the spring support part 165.

The plenum seating part 1922 extends inward from the plenum flange 1920 in the radial direction so that the spring assembly 163 is seated. In detail, the plenum seating part 1922 is bent forward in the axial direction to extend from an inner end of the plenum flange 1920 in the radial direction and then is bent again inward to extend in the radial direction. Thus, the plenum seating part 1922 has a cylindrical shape of which one end disposed at a front side in the axial direction is entirely bent inward in the radial direction.

Here, the plenum seating part 1922 contacts a rear end of the partition sleeve 1912. That is to say, the partition sleeve 1912 extends axially backward from the inside of the front surface of the chamber part 1915 to the plenum seating part 1922. That is, it may be understood that the plenum seating part 1922 is disposed between the spring support part 165 and the partition sleeve 1912 in the axial direction.

Here, the rear ends of the plenum seating part 1922 and the partition sleeve 1912 in the axial direction contact each other. That is, it may be understood that the plenum seating part 1922 and the partition sleeve 1912 contact each other in the axial direction. Thus, the refrigerant may be prevented from flowing between the plenum seating part 1922 and the partition sleeve 1912.

As described above, the third guide groove 1912*c* is recessed forward in the axial direction from the rear end of the partition sleeve 1912. Thus, the refrigerant may flow through the third guide groove 1912*c* between the partition sleeve 1912 and the plenum seating part 1922. That is, the third guide groove 1912*c* provides a passage of the refrigerant passing through the partition sleeve 1912 and the plenum seating part 1922.

The plenum body 1924 extends inward from the plenum seating part 1922 in the radial direction to define the first discharge chamber D1. In detail, the plenum body 1924 is bent forward in the axial direction to extend from an inner end of the plenum seating part 1922 in the radial direction and then is bent again inward to extend in the radial direction.

Thus, the plenum body 1924 has a cylindrical shape of which one end disposed at a front side in the axial direction is entirely bent inward in the radial direction. Here, the plenum body 1924 and the inner surface of the partition sleeve 1912 contact each other. That is, it may be understood that the plenum body 1924 and the partition sleeve 1912 contact each other in the radial direction. Thus, the refrigerant may be prevented from flowing between the plenum body 1924 and the partition sleeve 1912.

As described above, the first and second seating grooves 1912*a* and 1912*b* are recessed in the inner surface of the partition sleeve 1912. Thus, the refrigerant may flow through the first and second seating grooves 1912*a* and 1912*b* between the partition sleeve 1912 and the plenum body 1924. That is, the first and second seating grooves 1912*a* and 1912*b* define a passage of a refrigerant passing through the partition sleeve 1912 and the plenum body 1924.

Also, the first discharge chamber D1 and the second discharge chamber D2 may be distinguished from each other on the basis of the plenum body 1924*b*. In detail, the first discharge chamber D1 is disposed at a rear side of the plenum body 1924 in the axial direction, and the second discharge chamber D2 is disposed at a front side of the plenum body 1924 in the axial direction.

The plenum extension part 1926 extends backward in the axial direction from an inner end of the plenum body 1924 in the radial direction. That is, an opening defined in a central portion of the plenum body 1924 extends backward in the axial direction to provide a predetermined passage.

As described above, the refrigerant in the first discharge chamber D1 flows into the second discharge chamber D2 in the passage defined by the plenum extension part 1926. Particularly, the refrigerant in the first discharge chamber D1 may flow forward along the plenum extension part 1926 in the axial direction.

Also, the plenum extension part 1926 may extend backward in the axial direction to contact the spring assembly 163. In detail, the rear end of the plenum extension part 1926 in the axial direction may contact the front surface of the spring support 165.

The fixing ring 193 is inserted into an inner circumferential surface of the discharge plenum 192. Thus, the discharge plenum 192 may be prevented from being separated from the discharge cover 191.

That is, the fixing ring 193 may be understood as a structure for fixing the discharge plenum 192. Particularly, the fixing ring 193 may be inserted into the inner circumferential surface of the plenum body 1924 in a press-pitting manner.

The fixing ring 193 may be made of a material having a thermal expansion coefficient greater than that of the discharge plenum 192. For example, the fixing ring 193 is made of stainless steel, and the discharge plenum 192 is made of an engineering plastic material.

Here, the fixing ring 193 may have a predetermined assembly tolerance with the discharge plenum 192 at room temperature. Thus, the fixing ring 193 may be relatively easily coupled to the discharge plenum 192.

Also, when the linear compressor 10 is driven, heat is transferred from the refrigerant discharged from the compression space P, and the discharge plenum 192 and the fixing ring 193 are expanded. Here, the fixing ring 193 may be expanded more than the discharge plenum 192 and may contact the discharge plenum 192. Thus, the discharge plenum 192 may strongly contact the discharge cover 191.

Also, the discharge ring 193 prevents the refrigerant from leaking between the discharge cover 191 and the discharge plenum 192 because the discharge plenum 192 strongly contacts the discharge cover 191.

Also, the linear compressor 10 includes a gasket 194 disposed between the frame 110 and the discharge cover 191. In detail, the gasket 194 is disposed between the cover coupling part 1911 and the discharge frame surface 1120.

Particularly, the gasket 194 may be disposed on a portion at which the frame 110 and the discharge cover 191 are coupled to each other. That is, it is understood that the gasket 194 is configured to more tightly couple the frame 110 to the discharge cover 191.

The gasket 194 may be provided in plurality. Particularly, a plurality of gaskets 194 are provided at positions and in numbers corresponding to the flange coupling holes 1911*a* and the discharge coupling holes 1100. That is, the plurality of gaskets 194 may be provided in three that are spaced an angle about 120 degrees from each other in the circumferential direction.

Also, the gasket 194 is provided in the form of a ring having a gasket through-hole 194*a* defined in a center thereof. The gasket through-hole 194*a* may have a size corresponding to the flange coupling hole 1911*a* and the discharge coupling hole 1100.

Also, an outer diameter of the gasket 194 may be less than that of the outer side of the cover coupling part 1911. Thus, when the gasket through-hole 194 is aligned with the flange coupling hole 1911*a*, the gasket 194 may be disposed inside the cover coupling part 1911.

The discharge cover 191, the gasket 194, and the frame 110 are laminated so that the flange coupling hole 1911*a*, the gasket through-hole 194*a*, and the discharge coupling hole 1100 are sequentially arranged in the downward direction. Also, since a coupling member passes through the flange coupling hole 1911*a*, the gasket through-hole 194*a*, and the discharge coupling hole 1100, the discharge cover 191, the gasket 194, and the frame 110 may be coupled to each other.

Hereinafter, a flow of the refrigerant in the discharge space D will be described in detail based on the above-described structure. As described above, the discharge space D includes the first discharge chamber D1, the second discharge chamber D2, and the third discharge chamber D3.

Also, the first, second and third discharge chambers D1, D2 and D3 are defined by the discharge cover 191 and the discharge plenum 192. The first and second discharge chambers D1 and D3 are defined by the discharge plenum 192, and the second and third discharge chambers D2 and D3 are provided between the discharge plenum 192 and the discharge cover 191.

Also, the second discharge chamber D2 is defined in the axial direction of the first discharge chamber D1, and the third discharge chamber D3 is defined outward the first and second discharge chambers D1 and D2 in the radial direction.

Also, the discharge cover 191, the discharge plenum 192, and the fixing ring 193 contact each other and are coupled to each other. Also, the discharge valve assembly 160 may be seated at a rear side of the discharge plenum 192.

When a pressure in the compression space P is equal to or greater than that in the discharge space D, the valve spring 164 is elastically deformed toward the discharge plenum 192. Thus, the discharge valve 161 opens the compression space P so that the compressed refrigerant in the compression space P is guided to the first discharge chamber D1.

The refrigerant guided to the first discharge chamber D1 passes through the discharge plenum 192 and is guided to the second discharge chamber D2. Here, the refrigerant in the first discharge chamber D1 passes through the plenum extension part 1926 having a narrow cross-sectional area and then is discharged to the second discharge chamber D2 having a large cross-sectional area. Thus, noise due to pulsation of the refrigerant may be remarkably reduced.

The refrigerant guided to the second discharge chamber D2 moves backward in the axial direction along the first guide groove 1912*a* to move in the circumferential direction along the second guide groove 1912*b*. Also, the refrigerant moving in the circumferential direction along the second guide groove 1912*b* passes through the third guide groove 1912*c* and is guided to the third discharge chamber D3.

Here, the refrigerant in the second discharge chamber D2 passes through the first guide groove 1912*a*, the second guide groove 1912*b*, and the third guide groove 1912*c* having a narrow sectional area and then is discharged to the third discharge chamber D3 having a wide sectional area. Thus, the noise due to the pulsation of the refrigerant may be reduced once more.

Here, the third discharge chamber D3 is provided to communicate with the cover pipe 195. Thus, the refrigerant guided to the third discharge chamber D3 flows to the cover pipe 195. Also, the refrigerant guided to the cover pipe 195 may be discharged to the outside of the linear compressor 10 through the discharge pipe 105.

As described above, the refrigerant discharged from the compression space P may flow into the discharge space D defined in the discharge unit 190. Particularly, the refrigerant discharged in the compression space P may sequentially pass through the first discharge chamber D1, the second discharge chamber D2, and the third discharge chamber D3.

Here, in the discharge refrigerant, heat conduction transfer to the frame 110 and the cylinder 120 may occur. Also, heat of the frame 110 and the cylinder 120 may be transferred to the suction refrigerant accommodated in the piston 130. Thus, the suction refrigerant may increase in volume, and the compression efficiency may be improved.

As illustrated in FIGS. 11 to 13, the linear compressor 10 according to the second embodiment is provided with an insulation member 200*a* for preventing heat from being transferred. In detail, the insulation member 200*a* may be disposed to cover the entire surface of the cylinder 120 and the frame 110.

Particularly, the insulation member 200*a* is seated on the discharge cylinder surface 1200 and the discharge frame surface 1120.

A cylinder insulation seating part 1202 on which at least a portion of the insulation member 200*a* is seated and a discharge valve seating part 1204 on which at least a portion of the discharge valve 161 is seated is provided on the discharge cylinder surface 1200.

A frame insulation seating part 1121 on which at least a portion of the insulation member 200*a* is seated is disposed on the discharge frame surface 1120.

The frame insulation seating part 1121 may be provided in a ring shape and recessed backward from the discharge frame surface 1120 in the axial direction. Particularly, the frame insulation seating part 1121 is disposed outside the gas hole 1106 in the radial direction. Also, the terminal insertion hole 1104, the discharge coupling hole 1100, and the stator coupling hole 1102 are defined outside the frame insulation seating part 1121 in the radial direction.

Also, the cover flange part 1910 may have a diameter corresponding to the frame insulation seating part 1121. In detail, the diameter of the cover flange part 1910 is greater than the diameter of the frame insulation seating part 1121.

The insulation member 200*a* may have an inner diameter and an outer diameter and have a ring shape that extends in the radial direction. Here, the insulation member 200*a* includes a first insulation part 2002*a*, a second insulation part 2006, and a third insulation part 2004*a*.

The first insulation part 2002*a* may have a circular opening corresponding to the inner diameter. Also, the first insulation part 2002*a* may be disposed to contact the discharge valve seating part 1204 in the radial direction. That is to say, the outer diameter of the discharge valve seating part 1204 and the inner diameter of the insulation member 200 may be the same.

Also, a length of the first insulation part 2002*a* in the axial direction may be the same as the protruding height of the discharge valve seating part 1204 in the axial direction. Thus, top surfaces of the first insulation part 2002*a* and the discharge valve seating part 1204 in the axial direction may be disposed in the same line.

The second insulation part 2006 may be seated on the cylinder insulation seating part 1202. Also, a length of the second insulation part 2006 in the axial direction may be greater than that of the first insulation part 2002*a*. Furthermore, the length of the second insulation part 2006 in the axial direction may be greater than the recessed depth of the cylinder insulation seating part 1202 in the axial direction.

Thus, when the second insulation part 2006 is seated on the cylinder insulation part 1202, at least a portion of the second insulation part 2006 may protrude from the discharge cylinder surface 1200 in the axial direction.

Here, the discharge valve assembly 160 is disposed above the second insulation part 2006 in the axial direction. In detail, the second insulation part 2006 is disposed between the second cylinder insulation seating part 1202 and the spring support part 165.

Particularly, the second insulation part 2006 may be made of a material having elasticity and may contact the cylinder insulation seating part 1202 and the spring support part 165. Thus, the refrigerant may be prevented from leaking between the discharge cylinder surface 1200 and the spring support part 165.

The third insulation part 2004*a* may be seated on the frame insulation seating part 1121. That is, the third insulation part 2004*a* is disposed outside the first insulation part 2002*a* and the second insulation part 2006 in the radial direction.

Also, a length of the third insulation part 2004*a* in the axial direction may be greater than that of the first insulation part 2002*a* in the axial direction. Also, a length of the third insulation part 2004*a* in the axial direction may be equal to that of the second insulation part 2006 in the axial direction.

Furthermore, the length of the third insulation part 2004*a* in the axial direction may be greater than the recessed depth of the frame insulation seating part 1121 in the axial direction. Thus, when the third insulation part 2004*a* is seated on the cylinder insulation part 1121, at least a portion of the third insulation part 2004*a* may protrude from the frame cylinder surface 1120 in the axial direction.

Here, the discharge cover 1911 is disposed above the third insulation part 2004*a* in the axial direction. In detail, the third insulation part 2004*a* is disposed between the frame insulation seating part 1121 and the cover flange part 1910.

Particularly, the third insulation part 2004*a* may be made of a material having elasticity and may contact the frame insulation seating part 1121 and the cover flange part 1910. Thus, the refrigerant may be prevented from leaking between the discharge frame surface 1120 and the discharge cover 191.

Here, in the linear compressor according to the second embodiment, the fourth sealing member 129*d* is omitted. This is done because the insulation member 200*a* functions as the fourth sealing member 129*d*. In detail, the third insulation part 2004*a* may function as the fourth sealing member 129*d*.

Also, the third insulation part 2004*a* may define a circular outer appearance corresponding to the outer diameter. That is, the insulation member 200*a* extends outward from the first insulation part 2002*a* to the third insulation part 2004*a* in the radial direction. Thus, the second insulation part 2006 is disposed between the first insulation part 2002*a* and the third insulation part 2004*a* in the radial direction.

Also, the outer diameter of the insulation member 200*a* may correspond to the diameter of the frame insulation seating part 1121. Here, the correspondence means that the outer diameter of the insulation member 200*a* is less than the outer diameter of the frame insulation seating part 1121 and larger than the inner diameter of the frame insulation seating part 1202.

Also, an insulation through-hole 2000 corresponding to the gas hole 1106 is defined in the insulation member 200*a*. In detail, the insulation through-hole 2000 is defined in the radial direction between the insulation outer end 2004*a* and the insulation protrusion 2006 in the axial direction.

As described above, the insulation member 200*a* is provided to cover the discharge cylinder surface 1200 and the discharge frame surface 1120. Thus, the discharge refrigerant may be prevented from directly contacting the discharge cylinder surface 1200 and the discharge frame surface 1120. Thus, the heat of the discharged refrigerant may be prevented from being transferred to the cylinder 120 and the piston 130.

Also, the insulation member 200*a* may be disposed between the discharge frame surface 1120 and the discharge cover 191 to block the heat conducted from the discharge cover 191 to the discharge frame surface 1120.

Also, the insulation member 200*a* may function as the sealing member for preventing leakage of the refrigerant. Thus, the sealing member may be omitted, and the convenience of installation may increase.

The linear compressor including the above-described constituents according to the embodiment may have the following effects.

Since the heat of the frame is effectively dissipated, the heat transferred to the refrigerant suctioned into the linear compressor may be minimized to prevent the compression efficiency from being deteriorated by the overheating of the suction gas.

Particularly, the shell cover defining the flow guide may be provided in the front surface of the frame to effectively dissipate the heat of the frame. Also, the heat of the piston and the cylinder, which rises the temperature of the suctioned refrigerant, may be released to the outside through the frame, the heat transferred to the refrigerant suctioned from the piston and the cylinder may be minimized, and the suctioned refrigerant may be reduced in temperature to improve the compression efficiency.

Also, the entire shell may be reinforced in rigidity by the shell cover extending up to the front surface of the frame. Thus, the natural frequency of the shell may increase, and the noise transmitted to the outside may be reduced.

Also, the compressor body including the frame may be disposed to be fixed in the predetermined range by the shell cover. That is, the shell cover may serve as the stopper for the compressor body. Thus, it may be unnecessary to provide the separate stopper structure.

Also, the heat of the discharge refrigerant may be prevented from being transferred to the cylinder through the insulation member seated on the front surface of the cylinder that is exposed by the discharge refrigerant.

Also, since the amount of heat transferred to the cylinder decreases, the heat transferred to the suction refrigerant accommodated in the piston may be minimized, and the suctioned refrigerant may be reduced in temperature to improve the compression efficiency.

Also, since the insulation member is disposed between the discharge cover having the relatively high temperature and the frame, the heat of the discharge cover may be prevented from being conducted to the frame.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a shell that defines an internal space therein; and a compressor body disposed in the internal space of the shell, wherein the shell comprises:

a shell body that extends in an axial direction, the shell body having a first end and a second end that are open, a suction shell cover coupled to the first end of the shell body, and a discharge shell cover coupled to the second end of the shell body, the suction shell cover and the discharge shell cover closing the internal space of the shell, and wherein the discharge shell cover comprises:

a first portion that extends in the axial direction and that contacts an inner surface of the shell body, a second portion that extends from a first side of the first portion in a radial direction of the shell body and that closes one side of the internal space of the shell, and a third portion that extends from a second side of the first portion in the radial direction and that defines a discharge shell opening.

2. The linear compressor according to claim 1, wherein the compressor body comprises:

a cylinder;

a frame that accommodates at least a portion of the cylinder; and a discharge cover coupled to the frame, wherein the second portion of the discharge shell cover faces the discharge cover in the axial direction, and wherein the first portion of the discharge shell cover is disposed outside of the discharge cover in the radial direction and extends toward one side of the frame in the axial direction.

3. The linear compressor according to claim 2, wherein the discharge cover comprises:

a cover flange part coupled to of the frame; and a chamber part that extends from the cover flange part toward the second portion of the discharge shell cover in the axial direction, and wherein the third portion of the discharge shell cover extends in the radial direction along a plane defined by the cover flange part.

4. The linear compressor according to claim 3, wherein the discharge shell opening has a shape corresponding to a shape of the cover flange part, and extends outward of the cover flange part in the radial direction.

5. The linear compressor according to claim 1, wherein the compressor body comprises:

a cylinder that defines a compression space configured to compress refrigerant;

a discharge unit that defines a discharge space configured to receive refrigerant discharged from the compression space;

a frame body that accommodates at least a portion of the cylinder; and a frame flange that extends outward from the frame body in the radial direction, the frame flange comprising a frame heat-exchange surface coupled to the discharge unit, and wherein the third portion of the discharge shell cover is spaced apart from the frame heat-exchange surface in the axial direction to thereby define a first passage that allows refrigerant to flow between the third portion of the discharge shell cover and the frame heat-exchange surface.

6. The linear compressor according to claim 5, wherein the discharge unit comprises:

a cover flange part coupled to the frame heat-exchange surface; and a chamber part that extends from the cover flange part toward the second portion of the discharge shell cover in the axial direction, and wherein the third portion of the discharge shell cover is spaced apart from the cover flange part in the radial direction to thereby define a second passage that is in fluidic communication with the first passage and that allows refrigerant to flow between the third portion of the discharge shell cover and the cover flange part.

7. The linear compressor according to claim 6, wherein a width of each of the first passage and the second passage is less than a thickness of the discharge shell cover in the radial direction.

8. The linear compressor according to claim 6, wherein a width of each of the first passage and the second passage is less than a distance between an outer surface of the frame flange and an inner surface of the shell body in the radial direction.

9. The linear compressor according to claim 1, wherein the first portion of the discharge shell cover has a cylindrical shape having both ends that are open, wherein the ends of the first portion of the discharge shell cover comprise:

an outer end that is disposed outside of the shell and that defines an outer opening covered by the second portion of the discharge shell cover; and an inner end that is disposed inside of the shell body, the inner end defining an inner opening that faces the internal space of the shell, and wherein the third portion of the discharge shell cover is disposed at the inner end of the first portion of the discharge shell cover.

10. The linear compressor according to claim 9, wherein the second portion of the discharge shell cover is recessed from the outer end of the first portion of the discharge shell cover, and wherein the third portion of the discharge shell cover comprises a bent portion that extends from the inner end of the first portion of the discharge shell cover in the radial direction.

11. The linear compressor according to claim 1, wherein the first portion of the discharge shell cover defines a plurality of openings comprising:

a discharge pipe through-hole configured to receive a discharge pipe;

a process pipe through-hole configured to receive a process pipe; and a terminal through-hole configured to face a terminal connected to an external power source.

12. The linear compressor according to claim 1, further comprising:

a suction pipe coupled to the suction shell cover and configured to introduce refrigerant into the internal space of the shell; and a discharge pipe coupled to the shell body and configured to discharge refrigerant compressed in the internal space of the shell, and wherein the discharge pipe passes through the discharge shell cover and extends to an outside of the shell body.

13. The linear compressor according to claim 1, wherein the compressor body comprises:

a piston configured to compress refrigerant;

a motor assembly configured to apply driving force to the piston; and a terminal connected to the motor assembly and coupled to the shell body, and wherein the discharge shell cover defines a terminal through-hole that faces the terminal.

14. The linear compressor according to claim 1, wherein a length of the discharge shell cover in the axial direction is greater than or equal to a quarter of a length of the shell body in the axial direction.

15. The linear compressor according to claim 1, wherein a length of the discharge shell cover in the axial direction is greater than or equal to a double of a length of the suction shell cover in the axial direction.

16. The linear compressor according to claim 1, further comprising:

a cylinder that defines a compression space configured to receive refrigerant;

a piston disposed in the cylinder and configured to reciprocate in the in the axial direction and compress refrigerant in the cylinder;

a discharge unit that defines a discharge space configured to receive refrigerant discharged from the compression space;

a frame that accommodates at least portion of the cylinder and that is coupled to the discharge unit;

a discharge valve configured to open and close the compression space and control discharge of refrigerant from the compression space to the discharge space; and an insulation member disposed between the cylinder and the discharge unit, wherein the shell accommodates the cylinder, the piston, the discharge unit, the frame, the discharge valve, and the insulation member in the internal space of the shell, and wherein the cylinder comprises:

a discharge cylinder surface that faces the discharge unit, a discharge valve seating part that protrudes from the discharge cylinder surface toward the discharge unit and that is configured to seat the discharge valve, and a cylinder insulation seating part recessed from the discharge cylinder surface and configured to seat the insulation member.

17. The linear compressor according to claim 16, wherein the insulation member has a ring shape and extends from an inner circumference to an outer circumference in the radial direction, and wherein the insulation member comprises:

a first insulation part that defines a circular opening surrounded by the inner circumference and that contacts the discharge valve seating part; and a second insulation part disposed outside of the first insulation part in the radial direction and disposed on the cylinder insulation seating part.

18. The linear compressor according to claim 17, wherein a thickness of the first insulation part in the axial direction is less than a thickness of the second insulation part in the axial direction.

19. The linear compressor according to claim 17, wherein the cylinder insulation seating part is recessed from the discharge cylinder surface in the axial direction, and wherein a recessed depth of the cylinder insulation seating part in the axial direction is less than a thickness of the second insulation part in the axial direction.

20. The linear compressor according to claim 17, wherein the discharge valve seating part protrudes from the discharge cylinder surface in the axial direction, and wherein a protruding height of the discharge valve seating part in the axial direction is equal to a thickness of the first insulation part in the axial direction.

* * * * *